US011072506B2

(12) United States Patent
Miyake et al.

(10) Patent No.: US 11,072,506 B2
(45) Date of Patent: Jul. 27, 2021

(54) BELT DRIVING DEVICE WITH STEERING ROLLER

(71) Applicant: HEWLETT-PACKARD DEVELOPMENT COMPANY, L.P., Spring, TX (US)

(72) Inventors: Koji Miyake, Yokohama (JP); Satoru Hori, Yokohama (JP); Yuji Aoshima, Yokohama (JP); Kensuke Nakajima, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/754,972

(22) PCT Filed: Oct. 12, 2018

(86) PCT No.: PCT/KR2018/011999

§ 371 (c)(1),
(2) Date: Apr. 9, 2020

(87) PCT Pub. No.: WO2019/088494

PCT Pub. Date: May 9, 2019

(65) Prior Publication Data

US 2020/0299083 A1 Sep. 24, 2020

(30) Foreign Application Priority Data

Oct. 31, 2017 (JP) ..... JP2017-211080

(51) Int. Cl.
*B65H 5/02* (2006.01)

(52) U.S. Cl.
CPC ..... *B65H 5/021* (2013.01); *B65H 2403/533* (2013.01); *B65H 2404/251* (2013.01);
(Continued)

(58) Field of Classification Search
CPC ..... B65H 5/021; B65H 2403/533; B65H 2404/251; B65H 2404/253;
(Continued)

(56) References Cited

U.S. PATENT DOCUMENTS 8,792,812 B2 7/2014 Fujioka
9,145,262 B2 * 9/2015 Eagleson ..... B65G 39/16
(Continued)

FOREIGN PATENT DOCUMENTS

JP 11344906 12/1999
JP 2008268954 11/2008

*Primary Examiner* — Howard J Sanders
(74) *Attorney, Agent, or Firm* — Staas & Halsey LLP

(57) ABSTRACT

An imaging system comprises a pair of belt rollers to drive an endless belt along a belt path, the pair of belt rollers comprising a first roller and a second roller. A steering roller is located between the first roller and the second roller. The steering roller is tiltable to engage the endless belt. A wheel is located at an end of the first roller in abutment with an edge of the endless belt, to move along a rotation axis of the first roller, in an outward direction, when the endless belt shifts toward the wheel. A link mechanism transfers a movement of the wheel in the outward direction, to a tilting of the steering roller, in order to urge the endless belt to shift away from the wheel toward the belt path.

18 Claims, 16 Drawing Sheets

(52) U.S. Cl.
CPC ..... *B65H 2801/06* (2013.01); *G03G 2215/00151* (2013.01)

(58) Field of Classification Search
CPC ..... B65H 2404/2532; B65H 2404/286; G03G 2215/00151
See application file for complete search history.

(56) References Cited

U.S. PATENT DOCUMENTS

| | | | | |
|---|---|---|---|---|
| 2006/0067743 | A1 | 3/2006 | Nishikawa | |
| 2011/0070001 | A1 | 3/2011 | Morofushi | |
| 2015/0227089 | A1 | 8/2015 | Hozumi et al. | |
| 2018/0267437 | A1* | 9/2018 | Hozumi | G03G 15/1615 |
| 2021/0072671 | A1* | 3/2021 | Aoshima | B65H 5/025 |

* cited by examiner

BELT DRIVING DEVICE WITH STEERING ROLLER

CROSS REFERENCE TO RELATED APPLICATIONS

This application is a U.S. National Stage Application which claims the benefit under 35 U.S.C. § 371 of International Patent Application No. PCT/KR2018/011999 filed on Oct. 12, 2018, which claims foreign priority benefit under 35 U.S.C. § 119 of Japanese Patent Application No. 2017-211080 filed on Oct. 31, 2017, in the Japanese Intellectual Property Office, the contents of all of which are incorporated herein by reference.

BACKGROUND ART

In an image forming apparatus, for example, an endless belt may be used as a conveyor belt for conveying a sheet or an intermediate transfer belt for secondarily transferring a toner. The endless belt is wound around a drive roller and a suspension roller (driven roller) and is driven along a circumferential orbit when power generated by the drive roller is transmitted thereto.

The image forming apparatus may comprise a transfer belt device equipped to correct a rotation path of the transfer belt. When the transfer belt moves in the width direction, ribs may be provided on an inner circumferential surface (rear surface) of the transfer belt to contact a detection roller so that the detection roller rotates. A steering roller is tilted by the transmission of the rotation of the detection roller to correct the rotation path of the transfer belt. The ribs may be provided at the end portion of the transfer belt in the width direction and may be formed to protrude inward in the radial direction of the drive roller.

MODE FOR INVENTION

Figure 1:
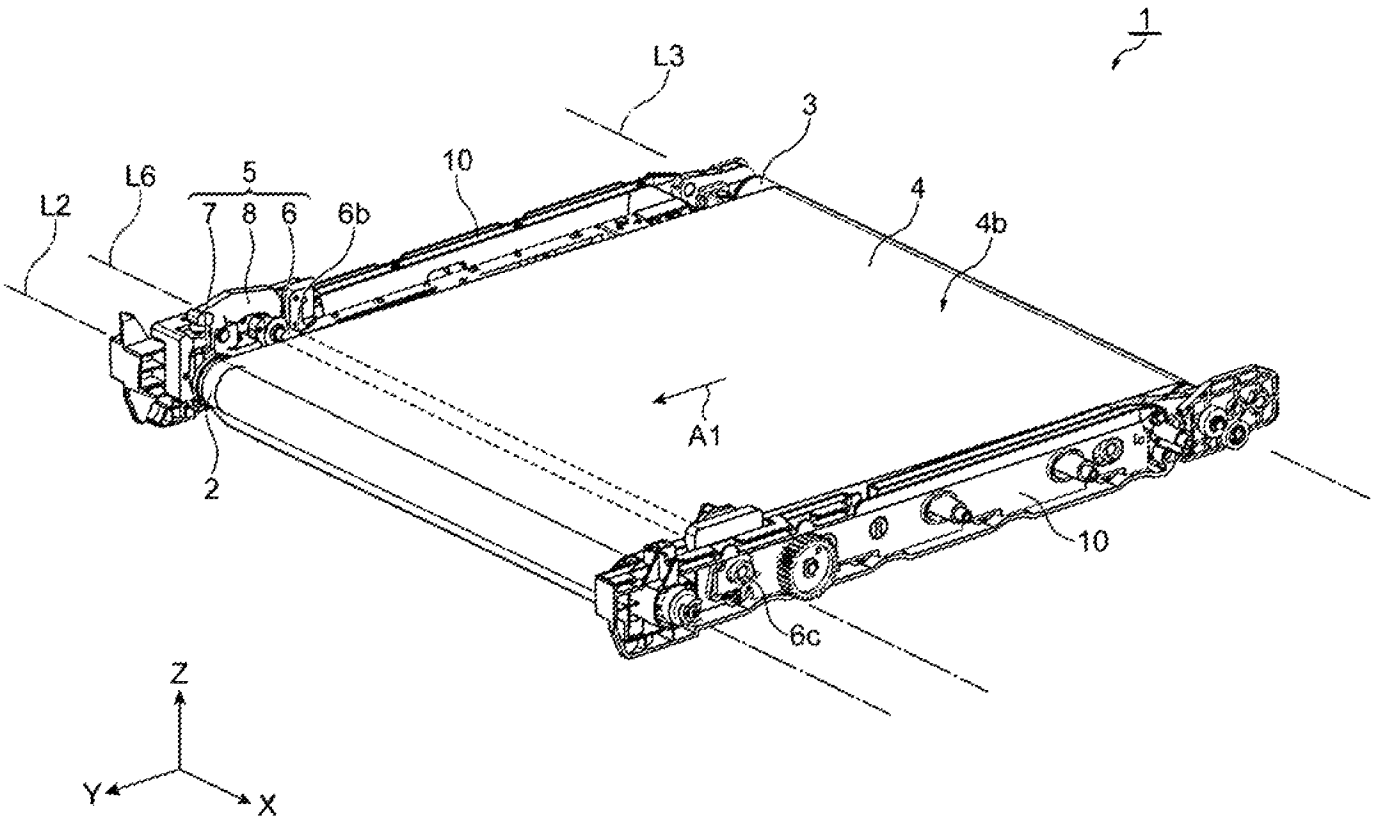
FIG. 1 is a perspective view of an example belt driving device.

In the following description, with reference to the drawings, the same reference numbers are assigned to the same components or to similar components having the same function, and overlapping description is omitted.

In an image forming apparatus, ribs may be provided on an inner circumferential surface (rear surface) of the transfer belt to contact a detection roller so that the detection roller rotates and engages a transmission mechanism to correct the rotation path of the transfer belt. When the ribs are depleted, the endless belt may move onto the detection roller even when the endless belt moves in the width direction and thus there is a possibility that the movement of the endless belt in the width direction may go undetected. Further, the movement of an endless belt without ribs, in the width direction, cannot be detected by the detection roller.

An example belt driving device includes a pair of belt rollers. The pair of belt rollers include a first roller and a second roller, for example a drive roller which drives an endless belt and a suspension roller which rotates in a following manner with the movement of the endless belt while the endless belt is wound thereon. The drive roller and the suspension roller extend in a first direction and face each other in a second direction intersecting the first direction. The belt driving device includes a steering roller which is located between the drive roller and the suspension roller. The steering roller rotates in a following manner with the movement of the endless belt. The steering roller is tiltable while one end portion in a longitudinal direction moves. In some examples, the driver roller is the first roller, with the suspension roller being the second roller of the pair of belt rollers. In other examples, the suspension roller is the first roller, with the drive roller being the second roller of the pair of belt rollers.

The belt driving device may include a wheel (or pulley). The wheel is inserted through an end portion of the first roller (e.g. the drive roller or the suspension roller). The wheel protrudes in a radial direction of the drive roller and is able to come into contact with an end surface of one end portion of the endless belt in a width direction. The wheel is pressed to move in the first direction with the movement of the endless belt in the first direction. The belt driving device includes a link mechanism. The link mechanism tilts the steering roller by moving the end portion of the steering roller with the outward movement of the wheel in the first direction.

In the belt driving device, when the endless belt moves in the width direction, the end surface of the endless belt may contact the wheel so that the wheel moves outward in the first direction. Accordingly, one end portion of the steering roller is moved by the displacement of the link mechanism to tilt the steering roller. The tension of the endless belt at one end portion of the steering roller becomes weak as compared with the other end portion. As a result, the endless belt moves toward the other end portion in the width direction so that the misalignment of the endless belt is corrected.

Further, the steering roller may be located between the first roller and the second roller to be located on the side of the first roller in relation to an intermediate point. For example, the steering roller may be located closer to the first roller than to the second roller. Also in such a configuration, it is possible to increase a movement speed of the endless belt at the time of tilting the steering roller. As a result, it is possible to correct the misalignment of the endless belt.

The end portion of the first roller may correspond to a first end portion, and the first roller may include a second end portion opposite the first end portion. The wheel may correspond to a first wheel and the link mechanism corresponds to a first link mechanism, and the belt driving device may comprise a second wheel and a second link mechanism at the second end portion of the first roller. For example, the wheel may be provided at each of both end portions of the first roller. The link mechanism may be provided at each of both sides in the first direction, so that the endless belt contacts the wheel when the endless belt moves in any direction along the first direction. For example, Accordingly, it is possible to correct the misalignment by tilting the steering roller and moving the endless belt in the width direction.

A maximum movement amount of the end portion of the steering roller in the third direction may be equal to or larger than a maximum strain amount of the belt driving device. Accordingly, it is possible to correct the misalignment of the endless belt in the width direction even when the belt driving device is distorted and the endless belt is displaced while the belt driving device is installed. Additionally, the third direction is set as a direction intersecting the first direction and the second direction.

In some examples, wheel may be provided at one end portion of the first roller, without any similar wheel at the other end of the first roller. The link mechanism may be provided the end portion of the first roller so as to correspond to the wheel (e.g. located adjacent the wheel), without any similar link mechanism at the other end of the first roller. Accordingly, the belt driving device may be provided with one wheel and one link mechanism to decrease the number of components and to simplify the configuration and improve a size, as compared with a case in which the wheel and the link mechanism are provided at both sides.

The link mechanism can tilt the steering roller by moving the end portion of the steering roller to move away from the endless belt in the third direction. The "direction moving away from the endless belt in the third direction" may indicate a direction moving away from the portion of the endless belt coming into contact with the steering roller. For example, when the steering roller is located below the endless belt on the assumption that the third direction is a vertical direction, the "direction moving away from the endless belt (the inside in the third direction)" may indicate the downward movement direction.

The link mechanism may include a first intermediate member. The first intermediate member is inserted through the end portion of the first roller at the outside of the wheel in the first direction. The first intermediate member moves outward in the first direction with the movement of the wheel. For example, the first intermediate member may be located at the end portion of the first roller, whereby the wheel is located between the first intermediate member and the endless belt in the first direction, and the first intermediate member being movable outwardly in the first direction with a movement of the wheel. The link mechanism may include a second intermediate member. The second intermediate member is swingable about an axis line extending in the first direction. The second intermediate member can press the end portion of the steering roller to move away from the endless belt (e.g. inwardly) in the third direction while swinging with the outward movement of the first intermediate member in the first direction.

The belt driving device may further include a biasing member (e.g. a first spring member) that urges a bearing member rotatably supporting the steering roller in a direction of pressing the endless belt in the third direction. Additionally, the "direction of pressing the endless belt in the third direction" may indicate a direction of moving close to the portion of the endless belt coming into contact with the steering roller and a direction opposite to the direction of moving away from the endless belt. For example, when the steering roller is located below the endless belt on the assumption that the third direction is a vertical direction, an "urging operation in the direction of pressing the endless belt (the outside in the third direction)" may indicate the upward urging operation.

The belt driving device may further include a lap amount adjustment mechanism which is located on an upstream side or a downstream side of the steering roller in a circumferential movement direction of the endless belt and presses the endless belt against the steering roller to increase a contact area between the endless belt and the steering roller. The lap amount may indicate, for example, a contact length between the outer circumferential surface of the steering roller and the inner circumferential surface of the endless belt in the circumferential direction of the steering roller. Accordingly, it is possible to reliably move the endless belt in the width direction in response to the inclination of the steering roller by increasing the lap amount. The lap amount adjustment mechanism may press the end portion of the endless belt in the width direction against the steering roller.

The link mechanism can tilt the steering roller by moving the end portion of the steering roller toward an upstream side or a downstream side in a circumferential movement direction of the endless belt.

The link mechanism may include a third intermediate member. The third intermediate member swings about an axis line extending in the third direction with the movement of the wheel at the outside of the wheel in the first direction. The link mechanism may include a fourth intermediate member. The fourth intermediate member includes a first guide portion. The first guide portion is tilted inward in the first direction as it moves away from the first roller in the second direction within a plane along the first direction and the second direction. The fourth intermediate member swings about an axis line extending in the third direction along with the swinging of the third intermediate member.

The link mechanism may include a slide member. The slide member supports a bearing member rotatably supporting the end portion of the steering roller. The slide member engages with the first guide portion, and is movable along the second direction. The link mechanism may include a second guide portion. The second guide portion extends along the second direction and guides a movement direction of the slide member.

The belt driving device may further include a biasing member (e.g. second spring member) that urges an end portion of the first guide portion, inward in the first direction (e.g. away from the second guide portion). For example, the spring urges the end portion that is opposite to another end of the first guide portion that is adjacent the first roller.

In a state in which the wheel is not pressed by the endless belt, a contact position between the steering roller and the endless belt may be deviated in a direction of pressing the endless belt by a maximum strain amount or more of the belt driving device from a position of the endless belt when the steering roller does not project in the third direction. Also in such a configuration, it is possible to generate a tension suitable for the endless belt and to increase the friction between the endless belt and the steering roller.

A contact length between the steering roller and the endless belt in the circumferential direction of the steering roller may be ¼ or more of the circumference of the steering roller, to increase the friction between the endless belt and the steering roller and to increase the tension applied to the endless belt.

The endless belt may be a transfer belt for transferring a toner image. The transfer belt can be formed by a resin and/or elastic body. An end portion of the transfer belt in the width direction may be located outside an image forming area in the first direction and may be formed to be harder or thicker than the image forming area.

The end portion of the endless belt in the width direction may be subjected to a high hardness treatment. The end portion of the endless belt in the width direction may be subjected to a high hardness coating treatment as the high hardness treatment. A reinforcement member may be located at the end portion of the endless belt in the width direction.

An example imaging system 1, 61 comprises a pair of belt rollers 2, 3 to drive an endless belt 4 along a belt path, the pair of belt rollers comprising a first roller 2, 3 and a second roller 2, 3 (for example a drive roller 2 and a suspension roller 3). A steering roller 6 is located between the first roller 2 and the second roller 3, and the steering roller 6 is tiltable to engage the endless belt 4. A wheel 7 is located at an end of the first roller 2 in abutment with an edge of the endless belt 4, to move the wheel 7 along a rotation axis L2 of the first roller 2, in an outward direction, when the endless belt 4 shifts toward the wheel 7. A link mechanism 8 transfers a movement of the wheel 7 in the outward direction, to a tilting of the steering roller 6, in order to urge the endless belt 4 to shift away from the wheel 7 toward the belt path. The imaging system may comprise an image forming apparatus 61 such as a printer or the like, or a portion thereof, such as a belt driving device 1 for example. In some examples, the first roller is the drive roller 2, with the second roller being the suspension roller 3. In other examples, the first roller is the suspension roller 3, with the second roller being the drive roller 3.

Figure 3:
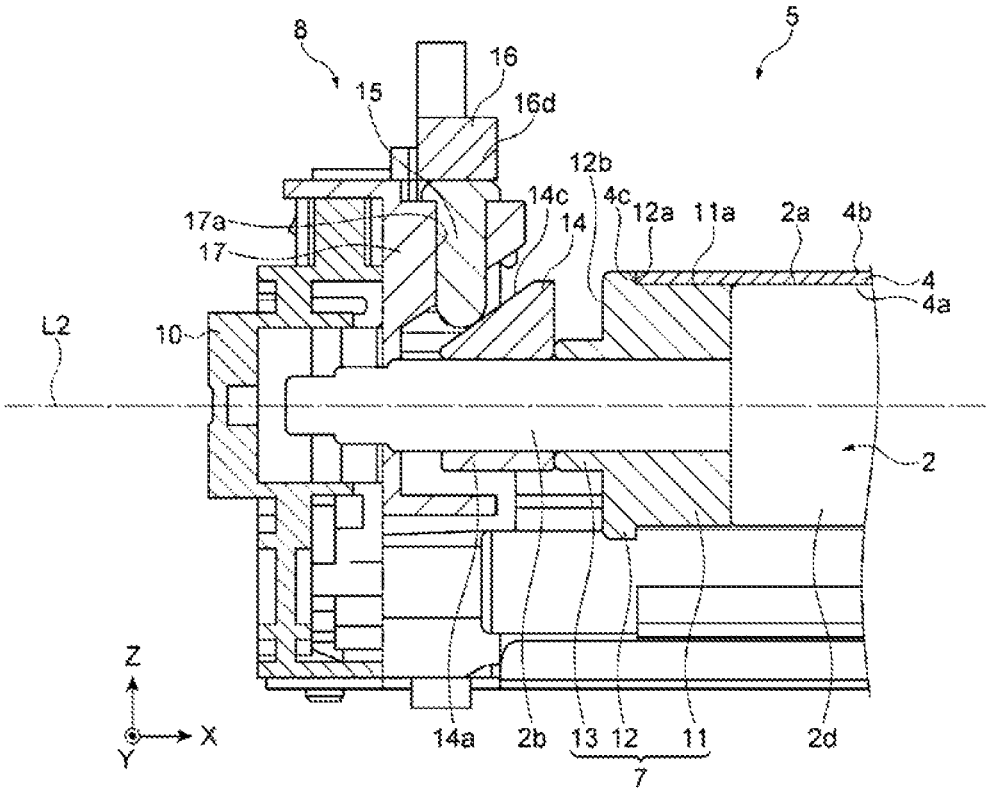
FIG. 3 is a cross-sectional view illustrating an end portion structure of an example drive roller, as viewed from the outside in the Y direction.
Figure 4:
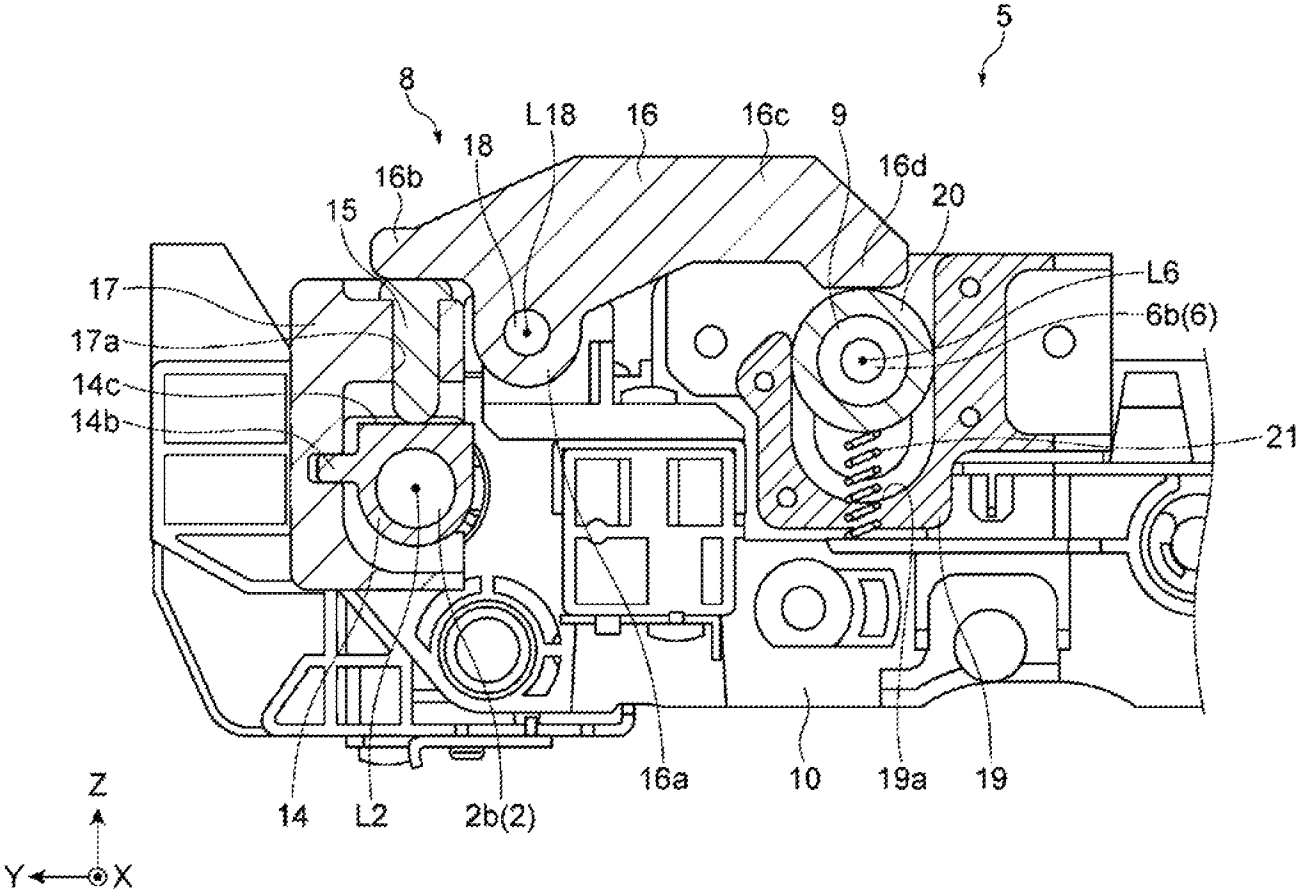
FIG. 4 is a cross-sectional view illustrating an example belt position correction unit, as viewed from the inside in the X direction.

With reference to FIGS. 3 and 4, the link mechanism 8 may comprise a shift member 14 adjacent the wheel 7, to be urged by the wheel 7 in the outward direction, wherein the shift member 14 has an inclined surface 14*c*, and wherein the link mechanism 8 comprises a pivoting arm 16 having a first end 16*a* and a second end 16*d* opposite the first end 16*a*, the first end 16*a* being coupled with the inclined surface 14*c* of the shift member 14, the first end 16*a* to be urged away from the rotation axis L2 of the first roller, by following the inclined surface 14*c* of the shift member 14, when the shift member 14 is moved in the outward direction, and the second end 16*d* being coupled with an end of the steering roller 6, the second end 16*d* to pivotally move when the first end 16*a* is urged, in order to tilt the steering roller 6.

Figure 14:
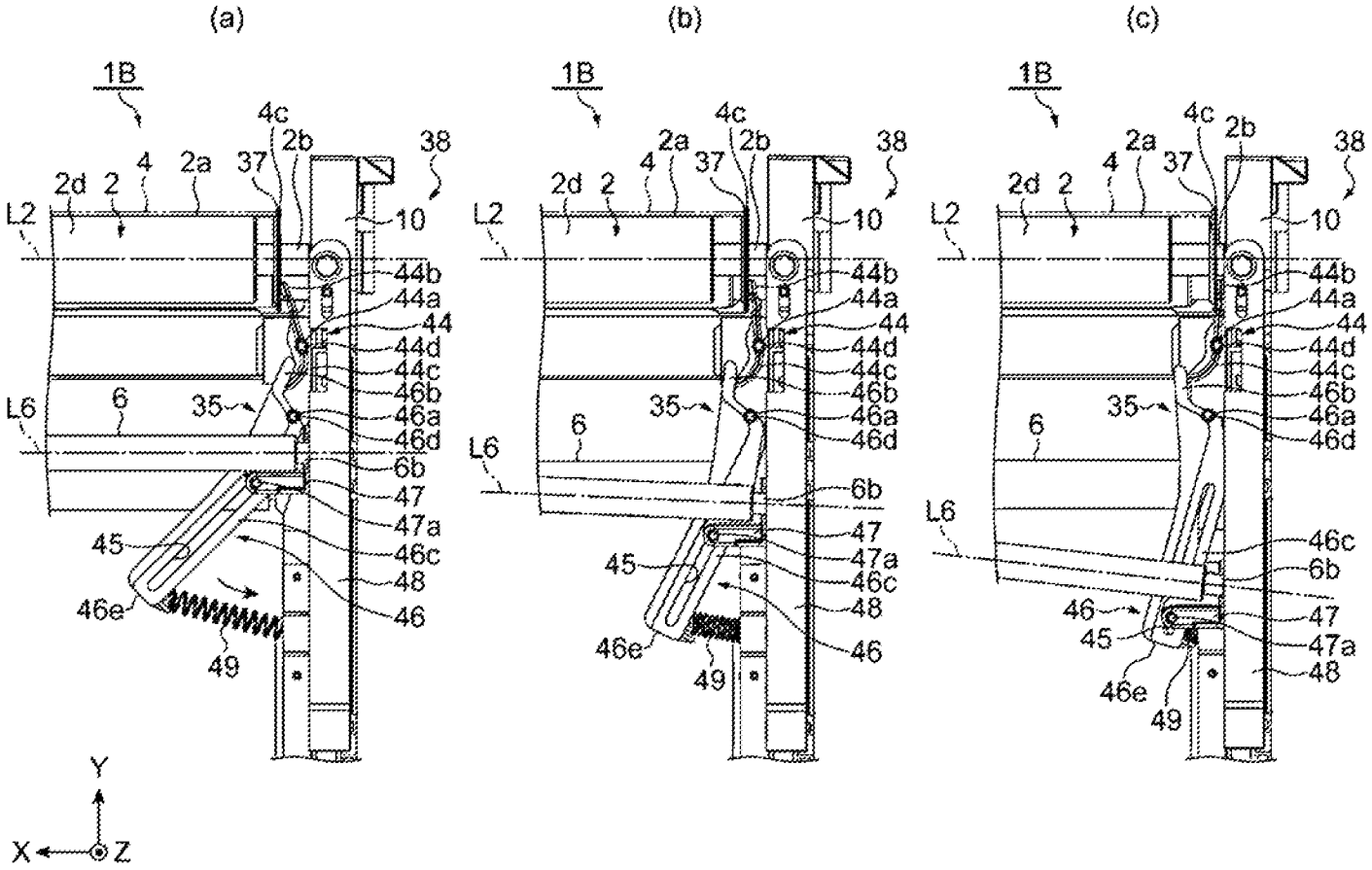
FIG. 14 shows plan views illustrating positions of the belt position correction unit illustrated in FIG. 13, where (a) shows a position of the belt position correction unit, (b) shows another position of the belt position correction unit, and (c) shows yet another position of the belt position correction unit.

With reference to FIG. 14(*a*), FIG. 14(*b*), FIG. 14(*c*), the link mechanism 38 may comprise a first pivotal arm 44 and a second pivotal arm 46. The first pivotal arm 44 is coupled to a side of the wheel 37. A movement of the wheel 37 in the outward direction urges the first pivotal arm 44 to pivot. The second pivotal arm 46 is coupled to the first pivotal arm 44, to pivot the second pivotal arm 46 responsive to a pivoting of the first pivotal arm 44. For example, the second pivotal arm 46 may pivot in a reverse manner relative to the first pivotal arm 44. The second pivotal arm 46 comprises a guide 45 to engage an end of the steering roller 6, in order to urge the steering roller 6 to tilt when the second pivotal arm 46 is tilted.

In an example image forming apparatus including an example belt driving device, the misalignment of the endless belt in the width direction is corrected to improve the generated image quality. In example belt driving devices and example image forming apparatus, it is possible to correct a misalignment by reliably detecting a movement of an endless belt in a width direction even in an endless belt without ribs.

Figure 2:
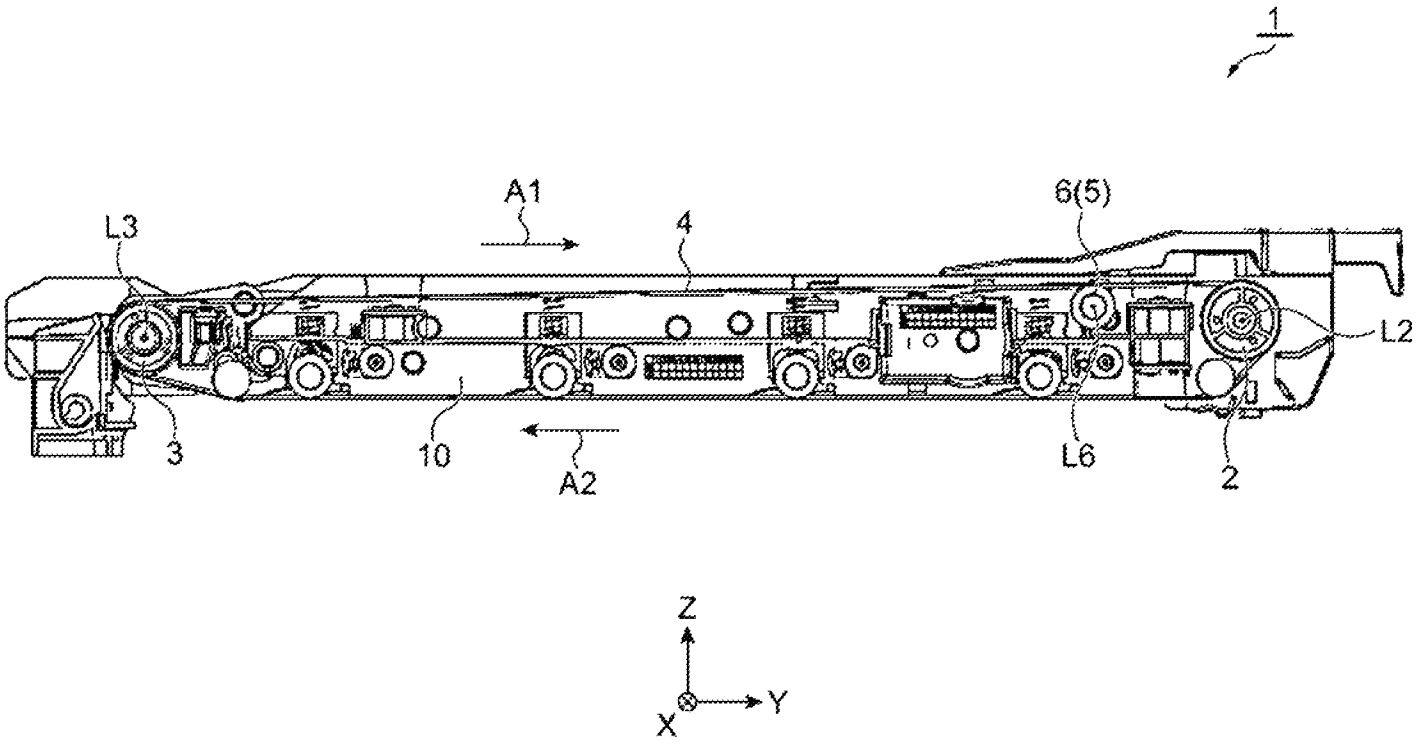
FIG. 2 is a side view of the belt driving device illustrated in FIG. 1.

An example belt driving device 1 illustrated in FIGS. 1 and 2 includes a drive roller 2, a suspension roller 3, and an endless belt 4. The drive roller 2 and the suspension roller 3 extend in an X direction (first direction) and face each other in a Y direction (second direction) intersecting the X direction. Additionally, a direction intersecting the X direction and the Y direction will be referred to as a Z direction. Power is transmitted from an electric motor (not illustrated) to the drive roller 2 so that the drive roller rotates about a rotation axis line L2 extending in the X direction. The endless belt 4 is wound on the drive roller 2 and the suspension roller 3 and moves along a circumferential orbit with the rotation of the drive roller 2. The suspension roller 3 rotates about a rotation axis line L3 with the movement of the endless belt 4. Bearings (not illustrated) which support the rollers 2 and 3 are supported by frames 10 located on both sides in the X direction and extending in the Y direction.

The belt driving device 1 is used as a transfer unit which secondarily transfers a toner image developed by a developing unit to a sheet, for example, in an image forming apparatus such as a printer. The endless belt 4 also serves as an intermediate transfer belt in the transfer unit. Further, the belt driving device 1 can be used as a sheet conveying unit which conveys a sheet. The endless belt 4 serves as a sheet conveyor belt in the sheet conveying unit.

The belt driving device 1 includes a belt position correction unit 5 which corrects the movement of the endless belt 4 in the width direction (the X direction). The belt position correction unit 5 includes a steering roller 6, a wheel (or pulley) 7, and a link mechanism 8. Additionally, the wheel 7 and the link mechanism 8 are not illustrated in FIG. 2.

The steering roller 6 is located between the drive roller 2 and the suspension roller 3 in the Y direction. The steering roller 6 is located on the upstream side of the drive roller 2 and the downstream side of the suspension roller 3 in a circumferential movement direction A1 of the endless belt 4. The steering roller 6 is located at the upper side of the circumferential orbit of the endless belt 4 to come into contact with an inner circumferential surface 4*a* (see FIG. 5)

of the endless belt 4 moving from the suspension roller 3 toward the drive roller 2. The steering roller 6 is located on the side of the drive roller 2 in relation to an intermediate point between the drive roller 2 and the suspension roller 3 in the Y direction and is located near the drive roller 2 in relation to the suspension roller 3.

An outer circumferential surface 6*a* of the steering roller 6 comes into contact with the inner circumferential surface 4*a* of the endless belt 4. The steering roller 6 rotates in a following manner about an axis line L6 with the circumferential movement of the endless belt 4. Both end portions (a first end portion 6*b* and a second end portion 6*c*) of the steering roller 6 are rotatably supported by a bearing (bearing member) 9. The bearing 9 is supported by the frames 10 located on both sides of the endless belt 4 in the width direction. The first end portion 6*b* of the steering roller 6 is displaceable in the Z direction (third direction). The steering roller 6 is tiltable about the second end portion 6*c* as a support point while the first end portion 6*b* is pressed. In the belt position correction unit 5, the wheel 7 and the link mechanism 8 are provided at the first end portion 6*b* of the steering roller 6. In some examples, the belt position correction unit 5 may be located at the first end 6*b* of the steering roller 6, without any similar belt position correction unit 5 at the second end portion 6*c* of the steering roller 6.

As illustrated in FIG. 3, the wheel 7 may be inserted through the first end portion 2*b* of the drive roller 2. The wheel 7 includes a cylindrical portion 11, a flange portion 12, and a small diameter portion 13. The wheel 7 is slidable in the extension direction of the drive roller 2. The outer diameter of the first end portion 2*b* of the drive roller 2 is smaller than the outer diameter of a main body portion 2*d* of the drive roller 2. The length of the main body portion 2*d* of the drive roller 2 in the X direction is slightly shorter than the width of the endless belt 4 (the length in the X direction). The outer diameter of the cylindrical portion 11 is substantially the same as the outer diameter of the main body portion 2*d* of the drive roller 2. An outer circumferential surface 11*a* of the cylindrical portion 11 and an outer circumferential surface 2*a* of the main body portion 2*d* of the drive roller 2 are located at the substantially same position from the axis line L2 in the radial direction of the drive roller 2. The outer circumferential surface 11*a* of the cylindrical portion 11 is able to come into contact with the inner circumferential surface 4*a* of the endless belt 4.

The flange portion 12 is formed in the entire circumference and protrudes outward in relation to the outer circumferential surface 11*a* of the cylindrical portion 11 in the radial direction. The flange portion 12 protrudes to the outside in relation to the outer circumferential surface 4*b* of the endless belt 4 in the radial direction. An inner surface 12*a* of the flange portion 12 faces an end surface 4*c* of the endless belt 4 in the X direction and is able to come into contact therewith. The inner surface 12*a* of the flange portion 12 is a surface facing the inside in the extension direction of the axis line L2 of the drive roller 2 and is a surface on the side of the endless belt 4. An outer surface 12*b* of the flange portion 12 is a surface facing the outside in the extension direction of the axis line L6 and is a surface on the side of the bearing. The small diameter portion 13 is a cylindrical portion having a diameter smaller than that of the cylindrical portion 11 and protrudes outward in the X direction.

The link mechanism 8 may include a first intermediate member 14, a pin member 15, and a second intermediate member 16. The first intermediate member 14 is inserted through the first end portion 2*b* of the drive roller 2 at the outside in relation to the wheel 7 in the X direction. For example, the first intermediate member 14 may be located at the end portion 2*b* of the first roller (e.g. drive roller 2), whereby the wheel 7 is located between the first intermediate member 14 and the endless belt 4 in the first direction X, and the first intermediate member 14 being movable outwardly in the first direction X with a movement of the wheel 7. The first intermediate member moves outward in the X direction with the movement of the wheel 7. The first intermediate member 14 includes a main body portion 14*a* provided with an opening portion and inserted through the first end portion 2*b*. A side portion of the main body portion 14*a* is provided with an overhanging piece 14*b* (see FIG. 4) which protrudes outward in the Y direction. The overhanging piece 14*b* is formed in, for example, a plate shape and extends in the X direction. A plate thickness direction of the overhanging piece 14*b* is a direction along the Z direction. An upper surface of the main body portion 14*a* is formed as an inclined surface 14*c*. The inclined surface 14*c* is tilted to move away from the axis line L2 as it moves from the outside toward the inside in the X direction. For example, the inclined surface is formed to be higher as it goes from the outside toward the inside in the X direction. Accordingly, when the first intermediate member 14 moves outward in the X direction, a member contacting the inclined surface 14*c* can be pressed upward.

The pin member 15 is formed in a columnar shape and extends in the Z direction. The pin member 15 is held by a holding member 17 fixed to the frame 10. The holding member 17 is provided with an opening portion 17*a* extending in the Z direction. The pin member 15 is inserted through the opening portion 17*a* to be held therein. A lower end portion of the pin member 15 is formed as, for example, a spherical surface. The lower end portion of the pin member 15 protrudes downward from the opening portion 17*a* and comes into contact with the inclined surface 14*c* of the first intermediate member 14. The pin member 15 is held by the holding member 17 and is movable in the Z direction. Further, an upper end portion of the pin member 15 is provided with a flange portion which protrudes in the radial direction of the pin member 15. The flange portion comes into contact with a circumferential edge portion of the opening portion 17*a* so as to prevent the pin member 15 from being dropped.

As illustrated in FIG. 4, the second intermediate member 16 includes a support point portion 16*a*, an accommodation portion 16*b*, a continuous portion 16*c*, and a pressing portion 16*d*. The support point portion (the pivot portion) 16*a* is supported by a support shaft 18 fixed to the frame 10. The support shaft 18 is located between the drive roller 2 and the steering roller 6 in the Y direction and extends in the X direction. The support shaft 18 protrudes inward in the X direction from the frame 10. The support point portion 16*a* is provided with an opening portion through which the support shaft 18 is inserted and the support shaft 18 is inserted through the opening portion. The support point portion 16*a* is rotatable about the support shaft 18. An axis line L18 of the support shaft 18 is located above, for example, the axis lines L2 and L6 in the Z direction.

The accommodation portion 16*b* is connected to the support point portion 16*a* and protrudes outward in the Y direction. The accommodation portion 16*b* is located at the upper side in relation to the support point portion 16*a*. The accommodation portion 16*b* extends to a position in which the accommodation portion is able to come into contact with the upper end portion of the pin member 15. The accommodation portion 16*b* comes into contact with the upper end portion of the pin member 15. The accommodation portion 16*b* is displaced with the movement of the pin member 15 in the Z direction. When the pin member 15 moves upward, the accommodation portion 16*b* moves upward with the upward movement.

The continuous portion 16*c* is connected to the support point portion 16*a* and extends inward in the Y direction. The continuous portion 16*c* extends to the opposite side to the accommodation portion 16*b* in the Y direction. The continuous portion 16*c* is located at the upper side in relation to the support point portion 16*a*. The continuous portion 16*c* extends to the upper side of the first end portion 6*b* of the steering roller 6. The continuous portion 16*c* swings in accordance with the rotation of the support point portion 16*a*. The pressing portion 16*d* is provided at a front end of the continuous portion 16*c*. The pressing portion 16*d* includes a surface which comes into contact with the outer circumferential surface of the bearing accommodation portion 20 accommodating the bearing 9. When the continuous portion 16*c* swings, the pressing portion 16*d* moves downward to press the bearing accommodation portion 20 and press the bearing 9 and the first end portion 6*b* of the steering roller 6 downward.

Figure 5:
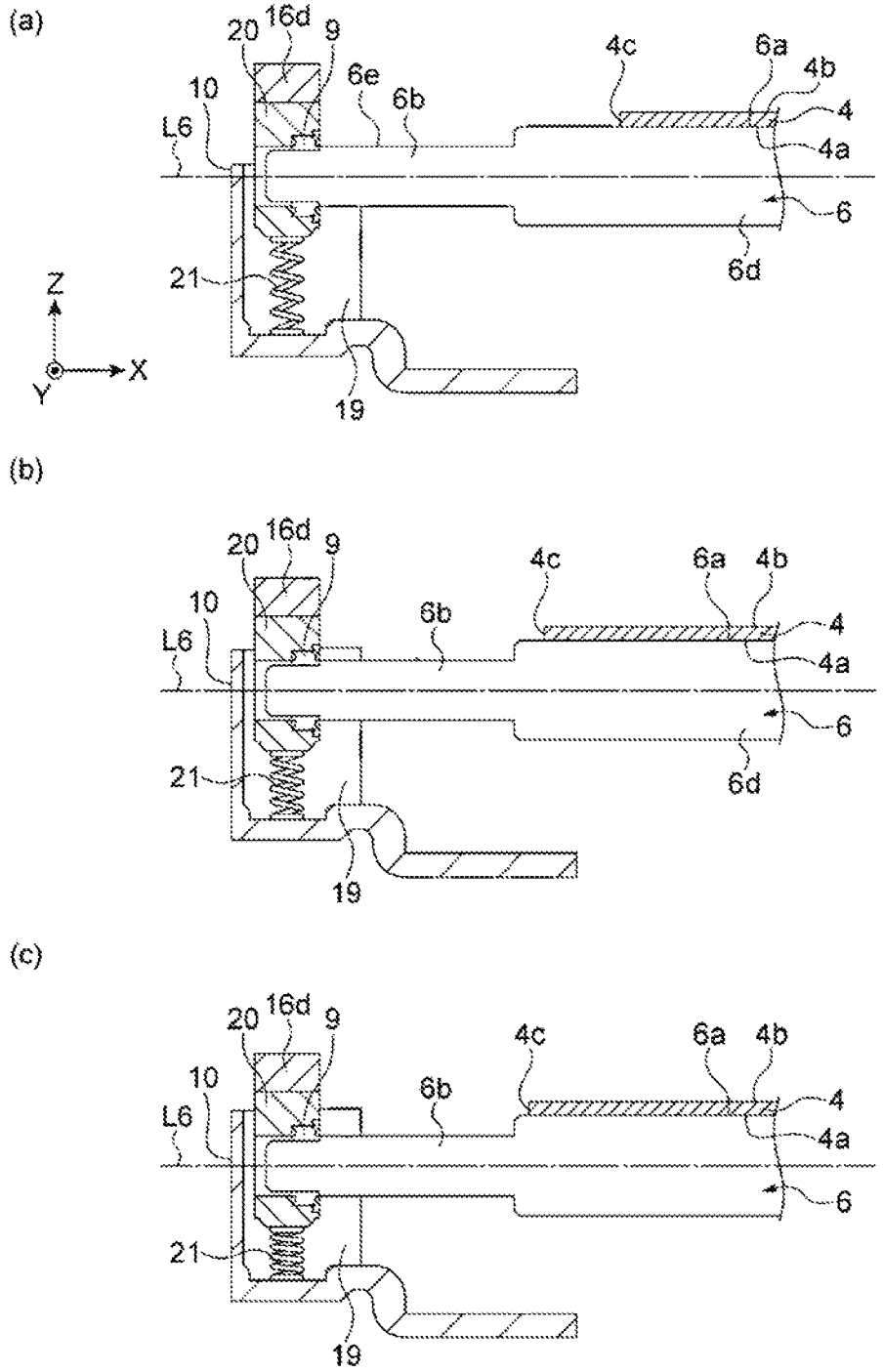
FIG. 5 shows cross-sectional views illustrating displacement positions of a first end portion of an example steering roller, where (a) shows a position of the first end portion, (b) shows another position of the first end portion and (c) shows yet another position of the first end portion.

As illustrated in FIGS. 4 and 5, the bearing accommodation portion 20 which accommodates the bearing 9 supporting the first end portion 6*b* is supported by a spring member (first spring member) 21 in the frame 10. The spring member 21 extends in the Z direction and supports the bearing accommodation portion 20 from below. A lower end portion of the spring member 21 is supported by a connection tool 19 fixed to the frame 10. The upper end portion of the spring member 21 is connected to the bearing accommodation portion 20. The spring member 21 is lengthened and shortened in the Z direction and urges the bearing accommodation portion 20 upward.

The connection tool 19 is provided with an accommodation portion 19*a* which holds the bearing accommodation portion 20. The accommodation portion 19*a* is a concave portion which is recessed downward and a facing wall surface of the concave portion in the Y direction comes into contact with the bearing accommodation portion 20 to restrict the movement direction of the bearing accommodation portion 20. Further, a bottom surface of the concave portion is able to come into contact with the bearing accommodation portion 20 and is able to restrict the downward movement range of the bearing accommodation portion 20.

An operation of the example belt driving device 1 will be described. Power is transmitted to the endless belt 4 by the drive roller 2 so that the endless belt 4 circumferentially moves. The suspension roller 3 rotates with the movement of the endless belt 4. Further, the steering roller 6 rotates with the movement of the endless belt 4.

Figure 6:
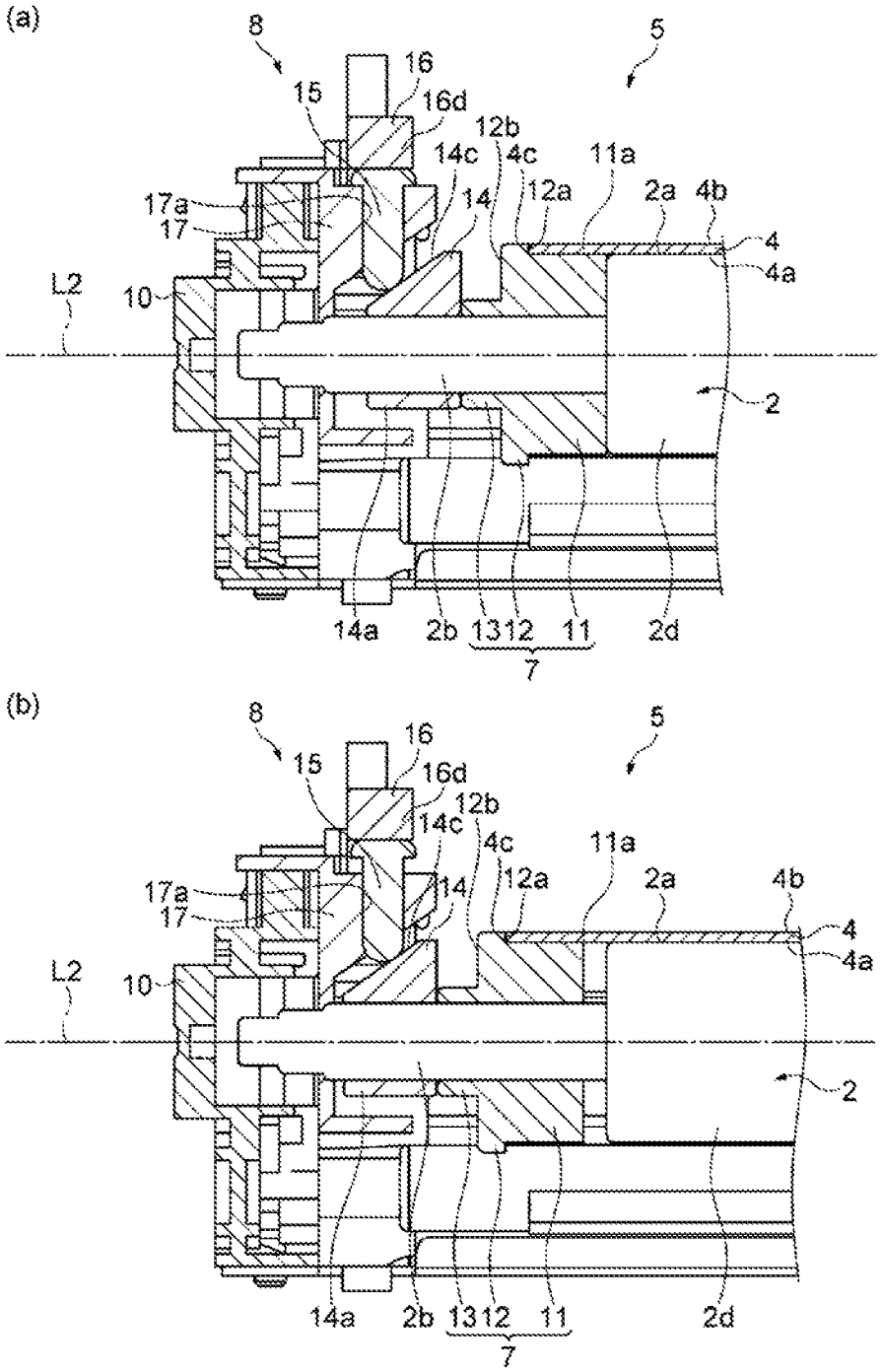
FIG. 6 shows cross-sectional views illustrating displacement positions of an example belt position correction unit, as viewed from the Y direction, where (a) shows a position of the belt position correction unit, and (b) shows another position of the belt position correction unit.
Figure 7:
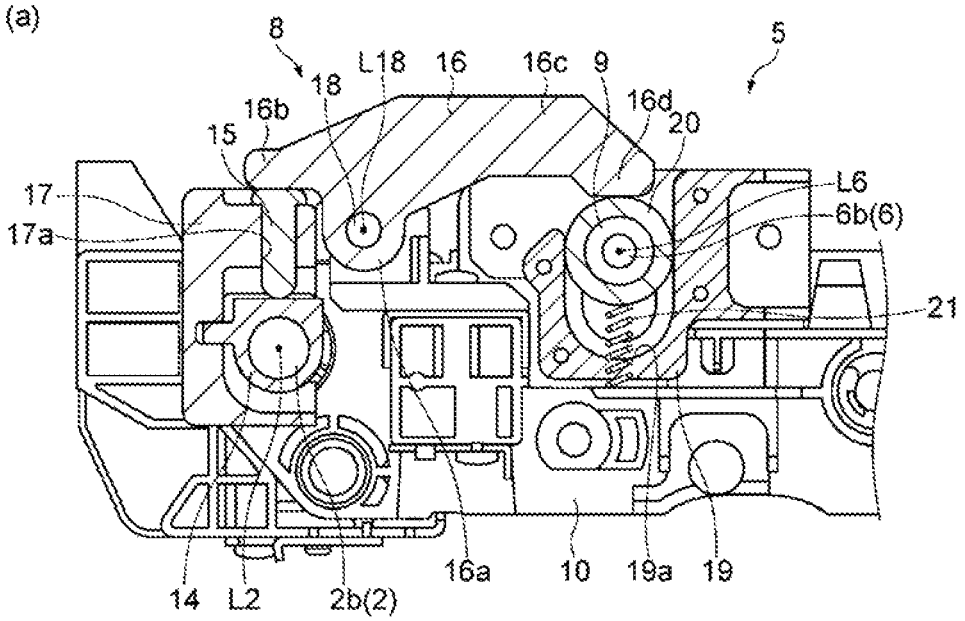
FIG. 7 shows cross-sectional views illustrating displacement positions of the belt position correction unit, as viewed from the X direction, where (a) shows a position of the belt position correction unit, and (b) shows another position of the belt position correction unit.
Figure 7:
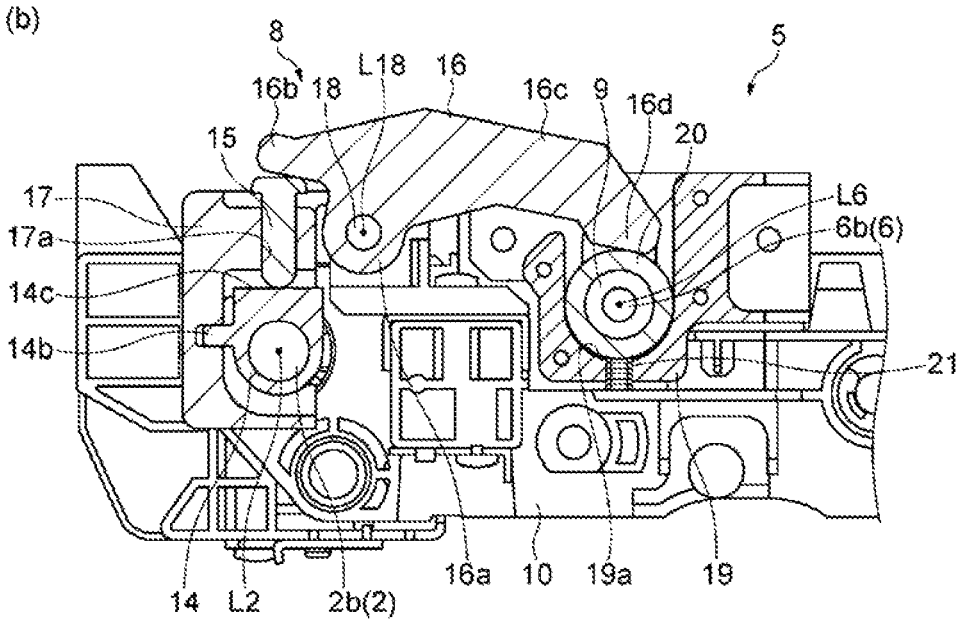

As illustrated in FIG. 6(*a*) and FIG. 6(*b*), when the endless belt 4 is displaced to the outside in the width direction toward the first end portion 2*b*, the end surface 4*c* of the endless belt 4 comes into contact with the inner surface 12*a* of the flange portion 12 of the wheel 7. When the movement amount of the endless belt 4 in the width direction increases, the endless belt 4 presses the wheel 7. When the wheel 7 moves to the outside from the state illustrated in FIGS. 6(*a*) and 7(*a*), the pin member 15 is pressed upward by the inclined surface 14*c* as illustrated in FIGS. 6(*b*) and 7(*b*). When the pin member 15 is displaced upward, the accommodation portion 16*b* of the second intermediate member 16 is pressed upward and the second intermediate member 16 swings about the axis line L18.

Accordingly, the pressing portion 16*d* is displaced downward to press the bearing accommodation portion 20 downward. As illustrated in FIG. 5, the first end portion 6*b* of the steering roller 6 moves downward so that the steering roller 6 is tilted.

When the steering roller 6 is tilted, the tension of the endless belt 4 becomes weak at the first end portion 6*b* compared to the second end portion 6*c*. As a result, the endless belt 4 moves toward the second end portion 6*c* in the width direction so that the misalignment of the endless belt 4 is corrected. Then, when the endless belt 4 moves toward the second end portion 6*c*, a force in which the endless belt 4 presses the wheel 7 outward in the X direction becomes weak. In accordance with this movement, since the spring member 21 urges the bearing accommodation portion 20 upward, the bearing 9 and the first end portion 6*b* move upward and the pressing portion 16*d* of the second intermediate member 16 moves upward. In accordance with this movement, the accommodation portion 16*b* moves downward so that the pin member 15 is pressed downward. When the pin member 15 coming into contact with the inclined surface 14*c* moves downward, the first intermediate member 14 moves inward in the X direction. The wheel 7 is pressed back by the first intermediate member 14 to return to an original position as illustrated in FIG. 6(*a*).

Accordingly, with the example endless belt 4 without ribs, the end surface 4*c* of the endless belt 4 is brought into contact with the wheel 7 and the second intermediate member 16 is driven to tilt the steering roller 6 by the movement of the first intermediate member 14 and the pin member 15. As a result, the movement of the endless belt 4 in the width direction can be corrected.

Since the misalignment of the endless belt 4 in the width direction is corrected, the meandering of the endless belt 4 can be suppressed. Further, in the belt driving device 1, the deformation (undulation) of the endless belt 4 due to a variation in tension of the endless belt 4 can be suppressed. In the intermediate transfer unit including the belt driving device 1, the uniformity of an image transferred onto the endless belt 4 can be secured.

Figure 8:
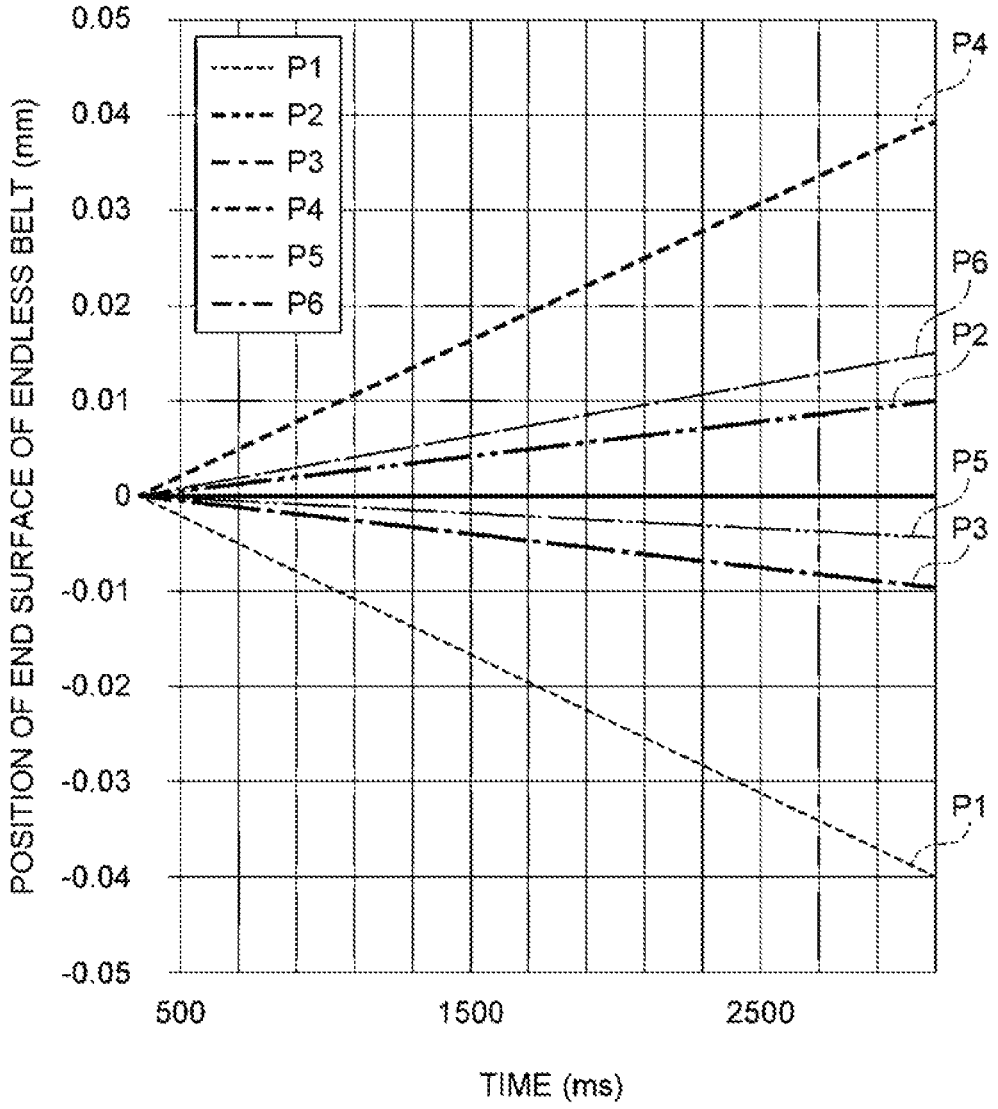
FIG. 8 is a graph showing a relationship between a position of the steering roller and a misalignment correction sensitivity of an endless belt, according to an example.

Next, a relationship between the arrangement position of the steering roller 6 and the movement speed of the endless belt 4 in the width direction will be described with reference to FIG. 8. In FIG. 8, a horizontal axis indicates a time [ms] and a vertical axis indicates the position of the end surface 4*c* of the endless belt 4. The position of the end surface 4*c* is the position of the endless belt 4 in the width direction and is the position in the extension direction of the axis line L6. At this time, the inclination angle of the steering roller 6 is the same.

Figure 9:
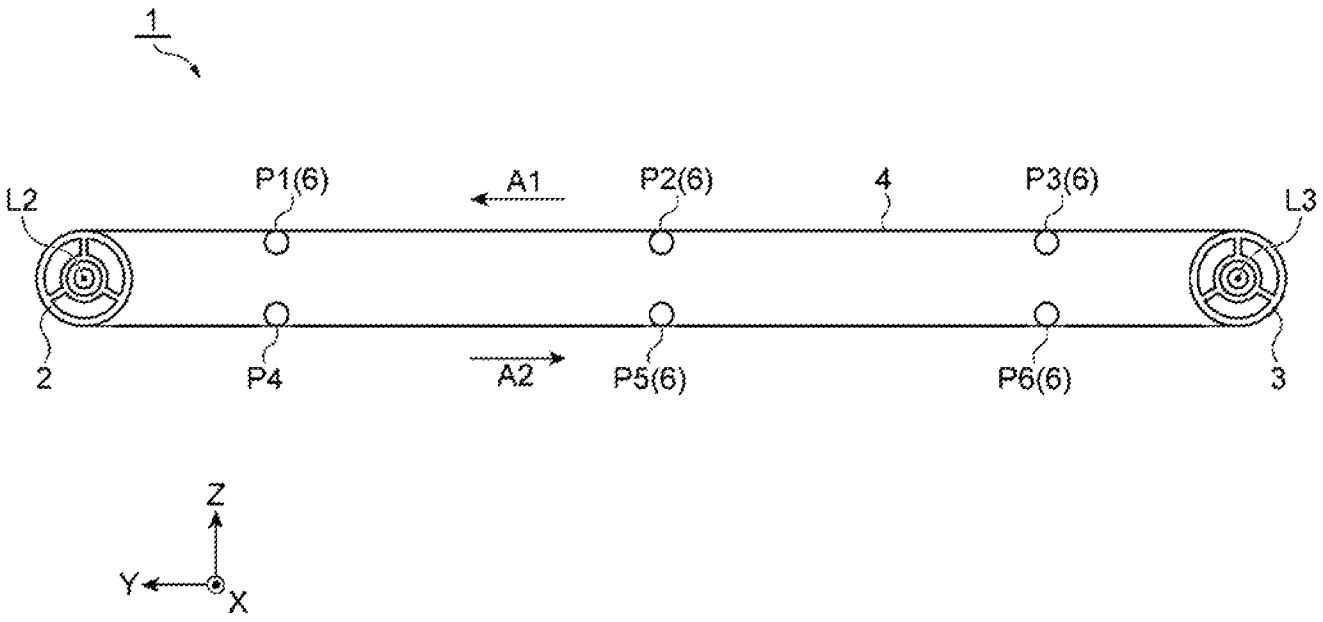
FIG. 9 is a side view illustrating an example arrangement of an endless belt, a drive roller, a suspension roller, and a steering roller.

As illustrated in FIG. 9, a change in position of the endless belt 4 in the width direction is measured while the arrangement positions P1 to P6 of the steering rollers 6 are changed. The arrangement positions P1 to P3 are located on the upstream side of the drive roller 2 and the downstream side of the suspension roller 3. At the arrangement positions P1 to P3, the endless belt 4 moves along the circumferential movement direction A1 from the suspension roller 3 toward the drive roller 2 (tension side). The arrangement positions P4 to P6 are located on the downstream side of the drive roller 2 and the upstream side of the suspension roller 3. At the arrangement positions P4 to P6, the endless belt 4 moves along a circumferential movement direction A2 from the drive roller 2 toward the suspension roller 3 (loose side). Further, the arrangement positions P1 and P4 are located in the vicinity of the drive roller 2 and the arrangement positions P3 and P6 are located in the vicinity of the suspension roller 3. The arrangement positions P2 and P5 are intermediate positions between the drive roller 2 and the suspension roller 3 in the Y direction.

As shown in FIG. 8, as the inclination of the graph increases, the movement amount of the endless belt 4 in the width direction increases and the correction sensitivity (response performance) increases. That is, it is effective that the misalignment of the endless belt 4 in the width direction can be corrected with high efficiency as the inclination of the graph increases. Since the inclination of the graph (P1, P4) is large as the steering roller 6 is close to the drive roller 2, the misalignment of the endless belt 4 in the width direction can be corrected with high efficiency.

Figure 10:
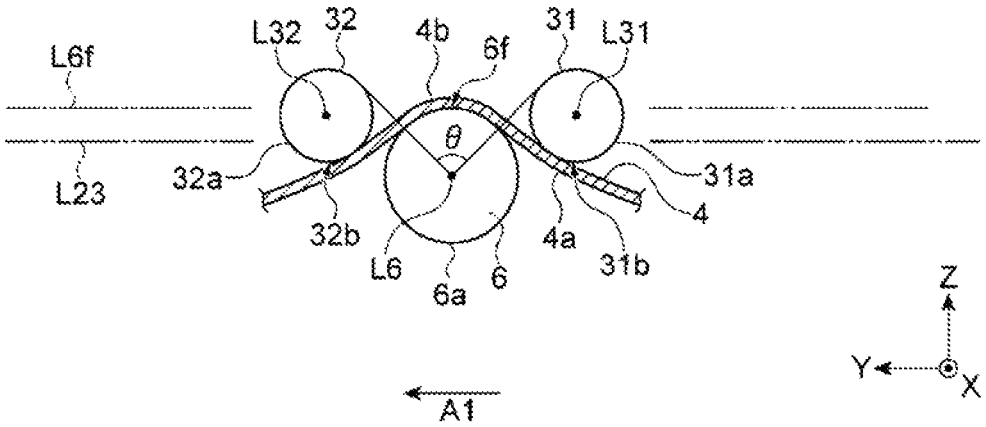
FIG. 10 is a diagram illustrating an arrangement of a lap amount adjustment roller of an example lap amount adjustment mechanism.

In an example belt driving device 1, lap amount adjustment rollers (lap amount adjustment mechanisms) 31 and 32 are further provided, as illustrated in FIG. 10.

The lap amount adjustment rollers 31 and 32 are located on the upstream side and the downstream side of the steering roller 6 in the circumferential movement direction A1 of the endless belt 4. The lap amount adjustment roller 31 is located on the upstream side of the steering roller 6 and the lap amount adjustment roller 32 is located on the downstream side of the steering roller 6. The bottom points of the outer circumferential surfaces 31*a* and 32*a* of the lap amount adjustment rollers 31 and 32 are located below the top points of the outer circumferential surfaces 6*a* of the steering rollers 6.

The lap amount adjustment rollers 31 and 32 are supported by the frame 10 on the side of the first end portion 6*b* of the steering roller 6. The lap amount adjustment rollers 31 and 32 are rotatable about axis lines L31 and L32 extending in the X direction. The lap amount adjustment rollers 31 and 32 come into contact with the outer circumferential surface 4*b* of the endless belt 4 and rotate in a following manner in accordance with the circumferential movement of the endless belt 4. As illustrated in FIG. 1, the lap amount adjustment rollers 31 and 32 are provided in the vicinity of the first end portion 6*b* of the steering roller 6 in the X direction. In some example belt driving devices, lap amount adjustment rollers 31 and 32 are located toward the first end portion 6*b* of the steering roller 6, without any similar lap amount adjustment rollers at the second end portion 6*c* of the steering roller 6. The lap amount adjustment rollers 31 and 32 press the endless belt 4 downward to increase a contact area between the steering roller 6 and the endless belt 4. A contact length between the outer circumferential surface 6*a* of the steering roller 6 and the inner circumferential surface 4*a* of the endless belt 4 in the circumferential direction of the steering roller 6 becomes ¼ or more of the circumference of the steering roller 6. For example, the outer circumferential surface 6*a* of the steering roller 6 contacts the endless belt 4 by 90° or more in the rotation angle q of the steering roller 6.

In this way, when the lap amount adjustment rollers 31 and 32 are provided, it is possible to increase the tension applied to the endless belt 4 by appropriately pressing the endless belt 4 against the steering roller 6.

In an example belt driving device 1, the first end portion 6*b* of the steering roller 6 applies a strain equal to or larger than the maximum strain amount of the belt driving device 1 to the endless belt 4 in a condition that the belt driving device 1 is installed in the initial state. Additionally, the initial state indicates a state in which the wheel 7 is not pressed by the end surface 4*c* of the endless belt 4 and the misalignment of the endless belt 4 in the width direction does not occur as illustrated in FIG. 3.

In the example belt driving device 1, a contact position L6*f* between the steering roller 6 and the endless belt 4 is deviated to the outside by a maximum strain amount or more of the belt driving device 1 from a position L23 of the endless belt 4 when the steering roller 6 does not project in the Z direction as illustrated in FIG. 10 in the initial state. The contact position L6*f* between the steering roller 6 and the endless belt 4 indicates the highest position in an area in which the steering roller 6 contacts the endless belt 4 and is, for example, a top point 6*f* of the outer circumferential surface 6*a* of the steering roller 6. Further, the position L23 of the endless belt 4 when the steering roller 6 does not project is, for example, the position of the tangent line which is in contact with the upper portion of the outer circumferential surface of the drive roller 2 and the upper portion of the outer circumferential surface of the suspension roller 3. Further, the maximum strain amount or more of the belt driving device 1 is, for example, the maximum strain amount or more when the belt driving device 1 is installed in a use environment and can be set to be equal to or larger than a difference in height between both end portions of the drive roller 2. For example, the first end portion 6*b* of the steering roller 6 is located at a slightly high position compared to the second end portion 6*c* in the initial state. Further, the maximum movement amount of the end portion of the steering roller 6 in the Z direction may be equal to or larger than the maximum strain amount of the belt driving device 1.

In the example belt driving device 1, since the tension of the first end portion 6*b* of the steering roller 6 with respect to the endless belt 4 is higher than that of the second end portion 6*c* in the initial state, the endless belt 4 is deviated to the first end portion 6*b* in relation to the second end portion 6*c*. For that reason, when the endless belt 4 moves to the first end portion 6*b*, the second intermediate member 16 of the link mechanism 8 is made to swing so that the first end portion 6*b* is pressed downward and the tilting degree of the steering roller 6 is changed. In this way, the endless belt 4 can be returned to the second end portion 6*c*. Accordingly, it is possible to correct the misalignment of the endless belt 4 in the width direction. Additionally, in the example belt driving device 1, the first end portion 6*b* of the steering roller 6 may apply a strain equal to or larger than the maximum strain amount of the belt driving device 1 in a condition that the belt driving device 1 is installed in the initial state to the endless belt 4.

Figure 11:
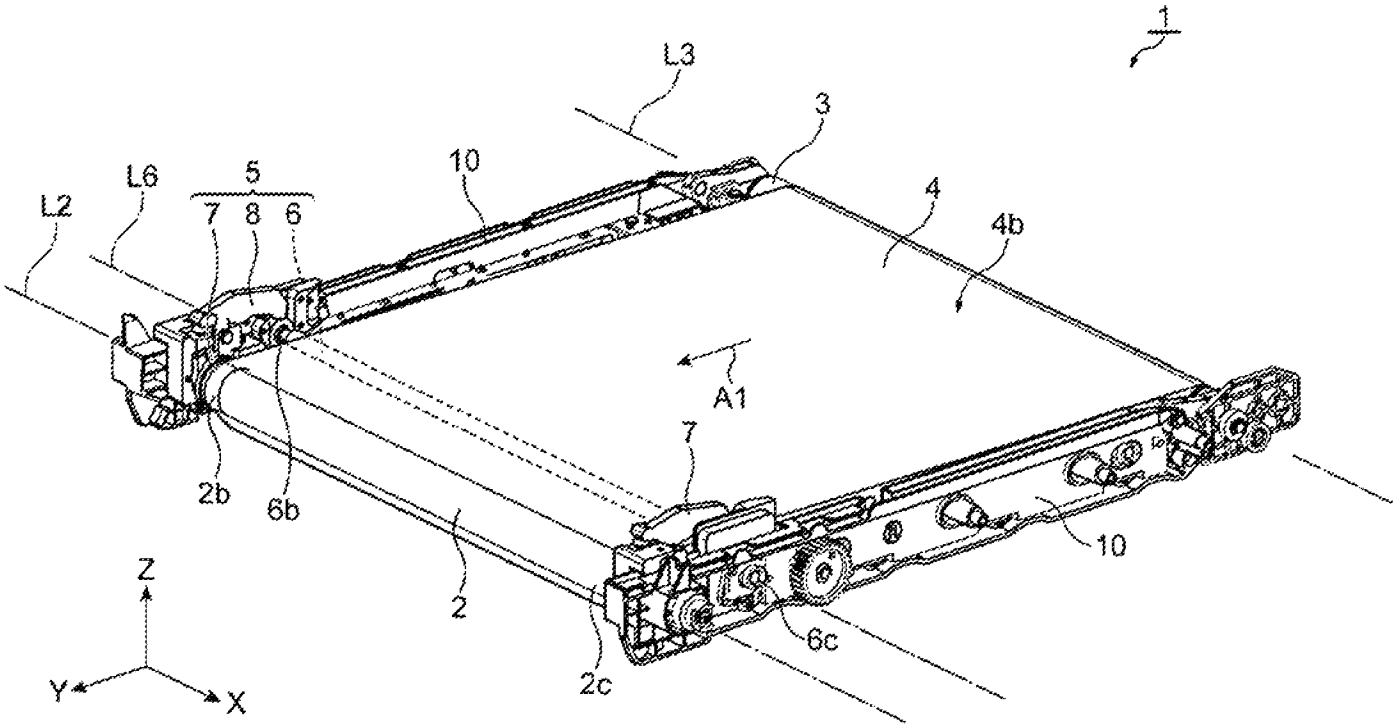
FIG. 11 is a perspective view illustrating an example belt driving device.

In an example belt driving device 1, as illustrated in FIG. 11, the wheel 7 may be provided at both end portions of the drive roller 2 and the link mechanism 8 may be provided at both sides in the X direction to correspond to the wheels. Similarly to the first end portion 2*b*, the second end portion 2*c* of the drive roller 2 may be provided with the wheel 7, the first intermediate member 14, the pin member 15, the second intermediate member 16, the holding member 17, the connection tool 19, and the spring member 21.

Even when the endless belt 4 is deviated in any direction, the endless belt contacts the wheels 7 located at both sides, power is transmitted by the link mechanism 8, and the first end portion 6*b* or the second end portion 6*c* of the steering roller 6 is pressed downward so that the steering roller 6 can be tilted, in order to correct the misalignment by returning the endless belt 4 to the opposite side.

Figure 12:
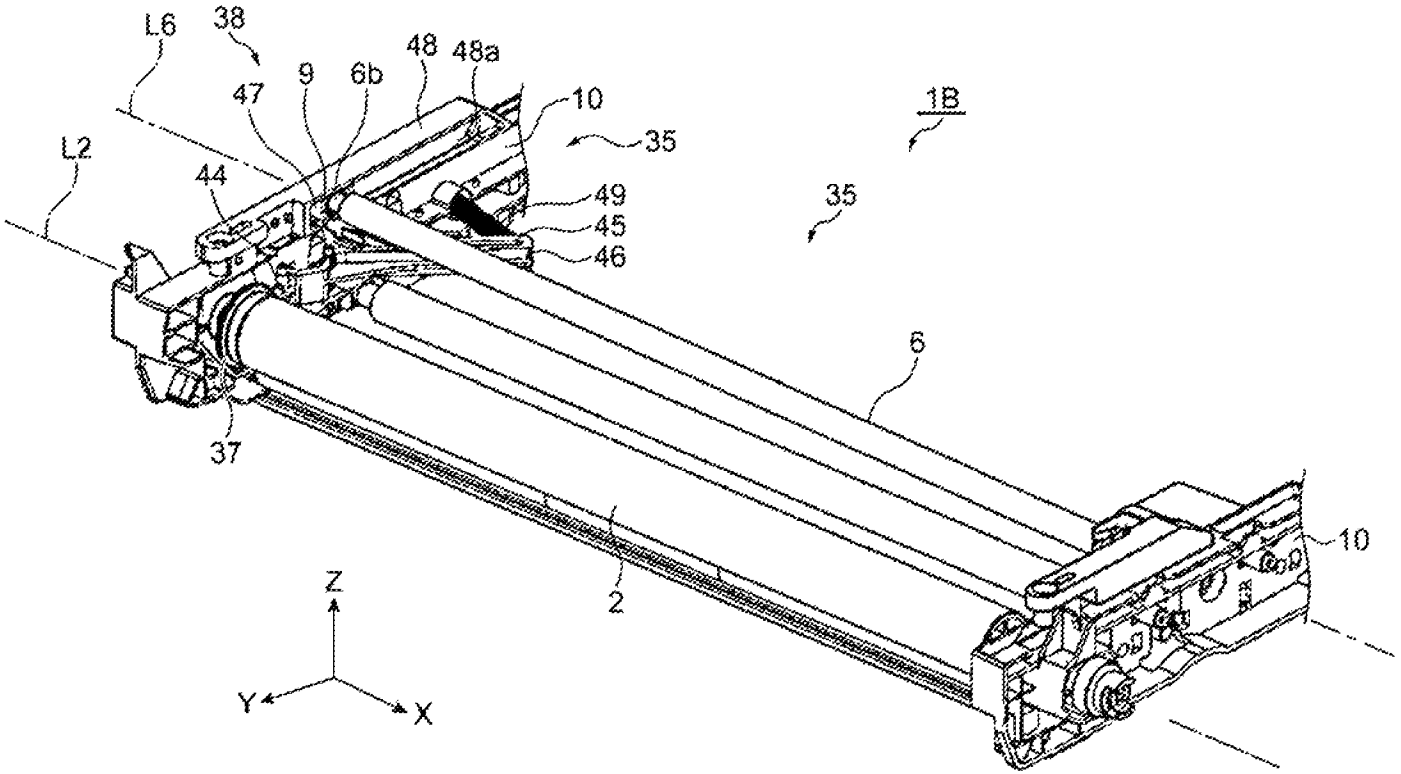
FIG. 12 is a perspective view illustrating a structure in the vicinity of a drive roller of an example belt driving device.
Figure 13:
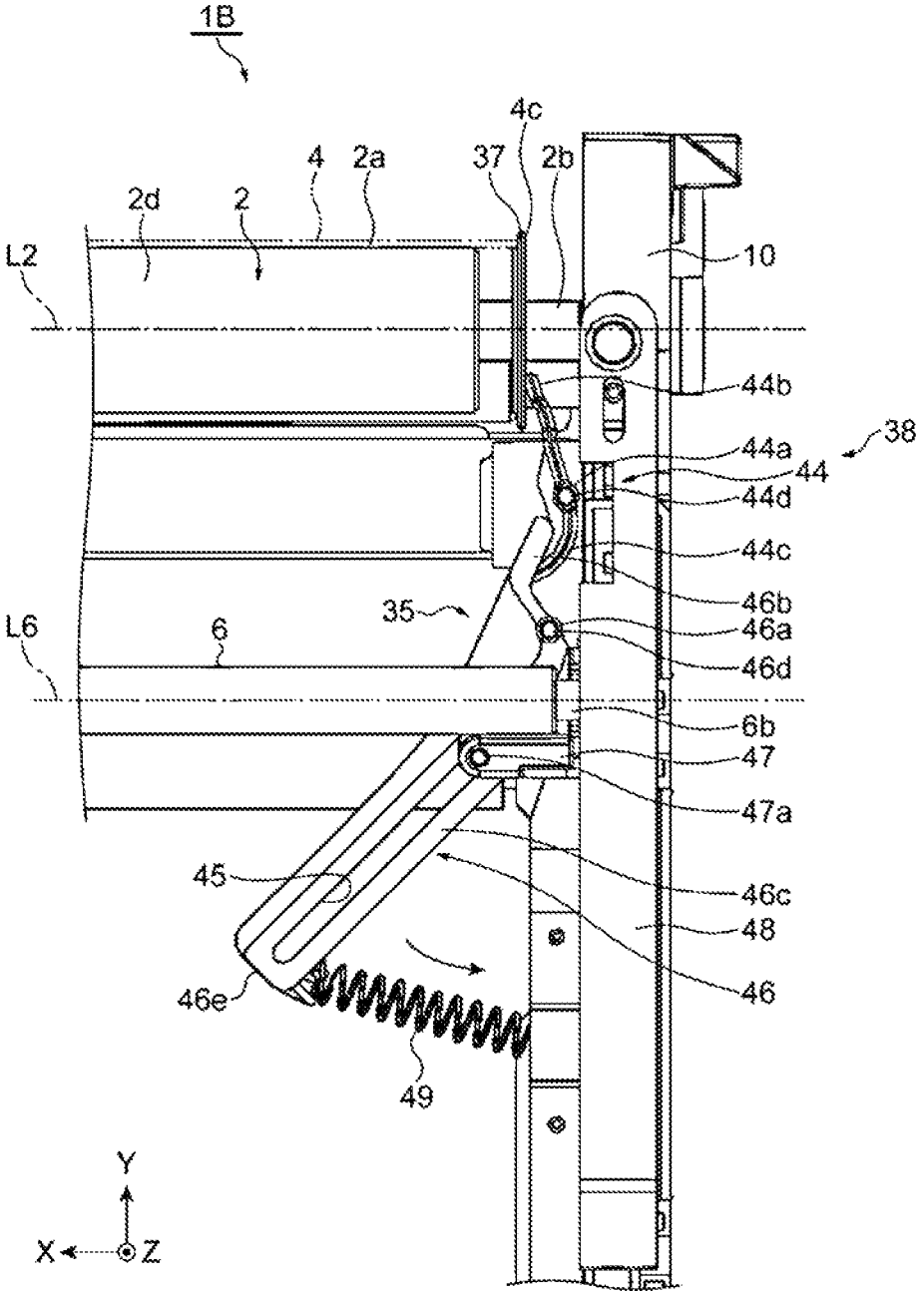
FIG. 13 is a plan view illustrating an example belt position correction unit of the belt driving device of FIG. 12.

An example belt driving device 1B illustrated in FIGS. 12 and 13 includes a belt position correction unit 35 In FIG. 12, the endless belt 4 is not illustrated. In FIG. 13, the endless belt 4 is indicated by an imaginary line (a two-dotted chain line).

The belt position correction unit 35 includes the steering roller 6, a wheel (or pulley) 37, and a link mechanism 38. The wheel 37 is formed in, for example, a disc shape and may be inserted through the first end portion 2*b* of the drive roller 2. An outer diameter of the wheel 37 protrudes outward in the radial direction in relation to the outer circumferential surface of the endless belt 4 coming into contact with the drive roller 2. The wheel 37 is able to come into contact with the end surface of the endless belt 4. The wheel 37 is movable outward in the X direction with the outward movement of the endless belt 4 in the X direction.

The link mechanism 38 includes, as illustrated in FIG. 13, a third intermediate member 44, a fourth intermediate member 46 including a first guide portion 45, a slide member 47, and a second guide member 48. The third intermediate member 44 includes a support point portion 44*a*, an accommodation portion 44*b*, and a pressing portion 44*c*.

The support point portion 44*a* is supported by a support shaft 44*d* fixed to the frame 10 to be rotatable about the support shaft 44*d*. The support shaft 44*d* is located between the drive roller 2 and the steering roller 6 in the Y direction and extends in the Z direction. The support point portion 44*a* is provided with an opening portion through which the support shaft 44*d* is inserted and the support shaft 44*d* is inserted through the opening portion.

The accommodation portion 44*b* is connected to the support point portion 44*a* and protrudes outward in the Y direction. The accommodation portion 44*b* extends to a position in which the accommodation portion is able to come into contact with the outer surface of the wheel 37. The accommodation portion 44*b* comes into contact with the outer surface of the wheel 37. The accommodation portion 44*b* is displaced with the movement of the wheel 37 in the X direction. When the wheel 37 moves outward in the X direction, the accommodation portion 44*b* swings outward in the X direction along with the outward movement.

The pressing portion 44*c* is connected to the support point portion 44*a* and extends inward in the Y direction. The pressing portion 44*c* extends to the opposite side to the accommodation portion 44*b* in the Y direction. The pressing portion 44*c* swings with the rotation of the support point portion 44*a*. The pressing portion 44*c* is curved as viewed from the Z direction. The pressing portion 44*c* is curved inward in the X direction as it moves away from the support point portion 44*a*.

The fourth intermediate member 46 includes a support point portion 46*a*, an accommodation portion 46*b*, and a continuous portion 46*c*. The fourth intermediate member 46 is located below the steering roller 6 in the Z direction. The support point portion 46*a* is supported by a support shaft 46*d* fixed to the frame 10 to be rotatable about the support shaft 46*d*. The support shaft 46*d* is located between the third intermediate member 44 and the steering roller 6 in the Y direction and extends in the Z direction. The support point portion 46*a* is provided with an opening portion through which the support shaft 46*d* is inserted and the support shaft 46*d* is inserted through the opening portion.

The accommodation portion 46*b* is connected to the support point portion 46*a* and extends outward in the Y direction. The accommodation portion 46*b* is curved to be recessed inward in the X direction as viewed from the Z direction. As it moves away from the support point portion 46*a* in the Y direction, the accommodation portion 46*b* is inclined inward in the X direction and is curved to be inclined outward in the X direction. The accommodation portion 46*b* extends to a position in which the accommodation portion is able to come into contact with the pressing portion 44*c* of the third intermediate member 44. The accommodation portion 46*b* is displaced with the inward movement of the pressing portion 44*c* of the third intermediate member 44 in the X direction. When the pressing portion 44*c* of the third intermediate member 44 moves inward in the X direction, the accommodation portion 46*a* of the fourth intermediate member 46 swings inward in the X direction along with the movement.

The continuous portion 46*c* includes the first guide portion 45. The continuous portion 46*c* is connected to the support point portion 46*a* and extends inward in the Y direction. The continuous portion 46*c* extends to the opposite side to the accommodation portion 46*b* in the Y direction. The continuous portion 46*c* is inclined inward in the X direction as it moves away from the support point portion 46*a* when viewed from the Z direction. For example, the continuous portion 46*c* extends linearly. The first guide portion 45 is an elongated hole formed along the continuous portion 46*c*. The elongated hole penetrates in, for example, the Z direction. The first guide portion 45 may be, for example, a groove portion extending along the continuous portion 46*c*.

A spring member (second spring member) 49 is connected to a front end portion 46*e* of the continuous portion 46*c*. The front end portion 46*e* of the continuous portion 46*c* is an end portion opposite to the support point portion 46*a* in the extension direction of the continuous portion 46*c*. One end portion of the spring member 49 is connected to the front end portion 46*e* of the continuous portion 46*c* and the other end portion of the spring member 49 is connected to the frame 10. The spring member 49 urges the front end portion 46*e* of the continuous portion 46*c* inward in the X direction.

The slide member 47 supports the bearing 9 and engages with the first guide portion 45. The slide member 47 includes a pin member 47*a* that engages with a first guide portion 48. The pin member 47*a* extends in the Z direction and a lower end portion of the pin member 47*a* is inserted into the first guide portion 45. The pin member 47*a* is movable along the first guide portion 45. Further, the slide member 47 engages with a second guide member 48 and is slidable in the Y direction.

The second guide member 48 extends in the Y direction. As illustrated in FIG. 12, the second guide member 48 is provided with a groove portion (second guide portion) 48*a* extending in the Y direction. The groove portion 48*a* opens, for example, to the inside in the X direction and is formed to be recessed outward in the X direction. The second guide member 48 is fixed to the frame 10. The second guide member 48 is located on, for example, the frame 10. A part of the slide member 47 is accommodated in the groove portion 48*a*. The bearing 9 which is held by the slide member 47 is movable along the groove portion 48*a*.

An operation of the belt position correction unit 35 of the belt driving device 1B will be described. As illustrated in FIG. 14, when the endless belt 4 is deviated to the outside in the width direction and to the first end portion 2*b*, the end surface 4*c* of the endless belt 4 contacts the wheel 37. When the movement amount of the endless belt 4 in the width direction increases, the endless belt 4 presses the wheel 37. When the wheel 37 moves outward from the state illustrated in FIG. 14(*a*), the accommodation portion 44*b* of the third intermediate member 44 is pressed out, the support point portion 44*a* rotates, and the pressing portion 44*c* swings inward in the X direction as illustrated in FIGS. 14(*b*) and 14(*c*).

The accommodation portion 46*b* of the fourth intermediate member 46 swings inward in the X direction with the movement of the pressing portion 44*c* of the third intermediate member 44. When the accommodation portion 46*b* swings, the support point portion 46*a* rotates and the continuous portion 46*c* swings outward in the X direction. The end portion 46*e* of the continuous portion 46*c* moves close to the frame 10. When the continuous portion 46*c* swings outward in the X direction, the pin member 47*a* of the slide member 47 moves along the first guide portion 45 with the displacement of the first guide portion 45 so that the slide member 47 moves inward in the Y direction toward the opposite side to the drive roller 2. The position of the pin member 47*a* is restricted by the first guide portion 45 and the pin member slides inward in the Y direction while a distance with respect to the frame 10 is maintained.

When the slide member 47 moves, the bearing 9 and the first end portion 6*b* of the steering roller 6 move inward in the Y direction. The steering roller 6 swings about the axis line extending in the Z direction using the second end portion 6*c* as a support point and is tilted with respect to the drive roller 2. Accordingly, a difference in tension occurs in the width direction of the endless belt 4. The tension of the endless belt 4 changes in response to a distance between the drive roller 2 and the steering roller 6 in the Y direction. The tension of the endless belt 4 becomes strong in the vicinity of the second end portion 6*c* close to the drive roller 2 and the steering roller 6 as compared with the vicinity of the first end portion 6*b*. Accordingly, since the endless belt 4 is deviated to the second end portion 6*c* in the width direction, a position is corrected.

When the endless belt 4 moves toward the second end portion 6*c*, a force in which the endless belt 4 presses the wheel 37 outward in the X direction becomes weak. Accordingly, since a force transmitted to the fourth intermediate member 46 through the third intermediate member 44 becomes weak, the spring member 49 urges the end portion 46*e* of the continuous portion 46*c* of the fourth intermediate member 46 so that the end portion 46*e* is pressed inward in the X direction. In response to the displacement of the continuous portion 46*c* and the first guide portion 45, the slide member 47 moves outward in the Y direction. Accordingly, the bearing 9 and the first end portion 6*b* of the steering roller 6 move to approach the drive roller 2 and return to an original position as illustrated in FIG. 14(*a*).

In this way, also in the belt driving device 1B, the position of the endless belt 4 in the width direction can be corrected. Further, since the movement direction of the steering roller 6 is a direction along the XY plane, it is possible to suppress a thickness of the belt driving device 1B in the Z direction.

Figure 15:
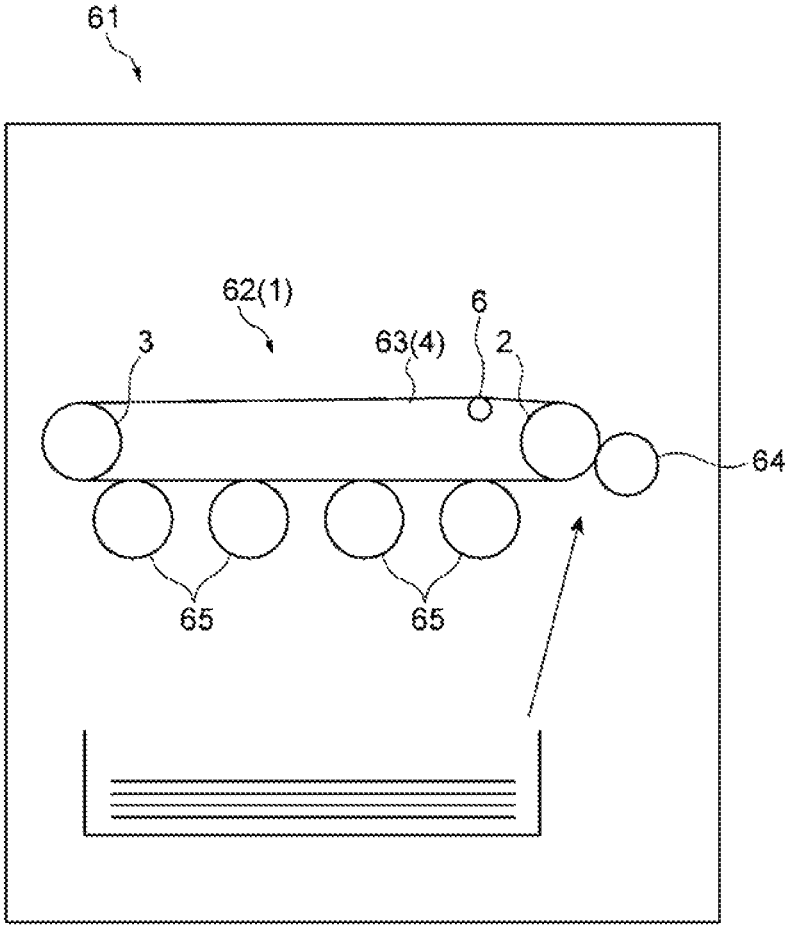
FIG. 15 is a schematic diagram illustrating a color image forming apparatus including an intermediate transfer unit.

As illustrated in FIG. 15, an example color image forming apparatus 61 includes the belt driving device 1 as an intermediate transfer unit 62. The intermediate transfer unit 62 includes the drive roller 2, the suspension roller 3, an intermediate transfer belt 63 which is the endless belt 4, and a secondary transfer roller 64. The secondary transfer roller 64 is arranged to press a sheet which is a recording medium against the intermediate transfer belt 63 moving along the drive roller 2. The color image forming apparatus 61 includes a photosensitive body 65 and various configurations necessary as the image forming apparatus. The photosensitive body 65 is located at a plurality of positions along the movement direction of the intermediate transfer belt 63.

A toner image formed on the photosensitive body 65 is primarily transferred to the intermediate transfer belt 63. The primarily transferred toner image is secondarily transferred to the sheet pressed by the secondary transfer roller 64. The toner image which is secondarily transferred to the sheet is fixed by a fixing device (not illustrated). Further, the intermediate transfer unit 62 is provided with a cleaning blade (not illustrated) which removes the residual toner adhering to the intermediate transfer belt 63. The cleaning blade is pressed against the intermediate transfer belt 63 to remove the residual toner.

Since such a color image forming apparatus 61 also includes the belt driving device, it is possible to prevent the misalignment of the intermediate transfer belt 63 in the width direction. In the intermediate transfer unit 62, a deformation such as undulation of the intermediate transfer belt 63 is prevented. For that reason, it is possible to prevent a decrease in adhesion between the cleaning blade and the intermediate transfer belt 63, to appropriately remove the residual toner, and to improve the image quality.

Figure 16:
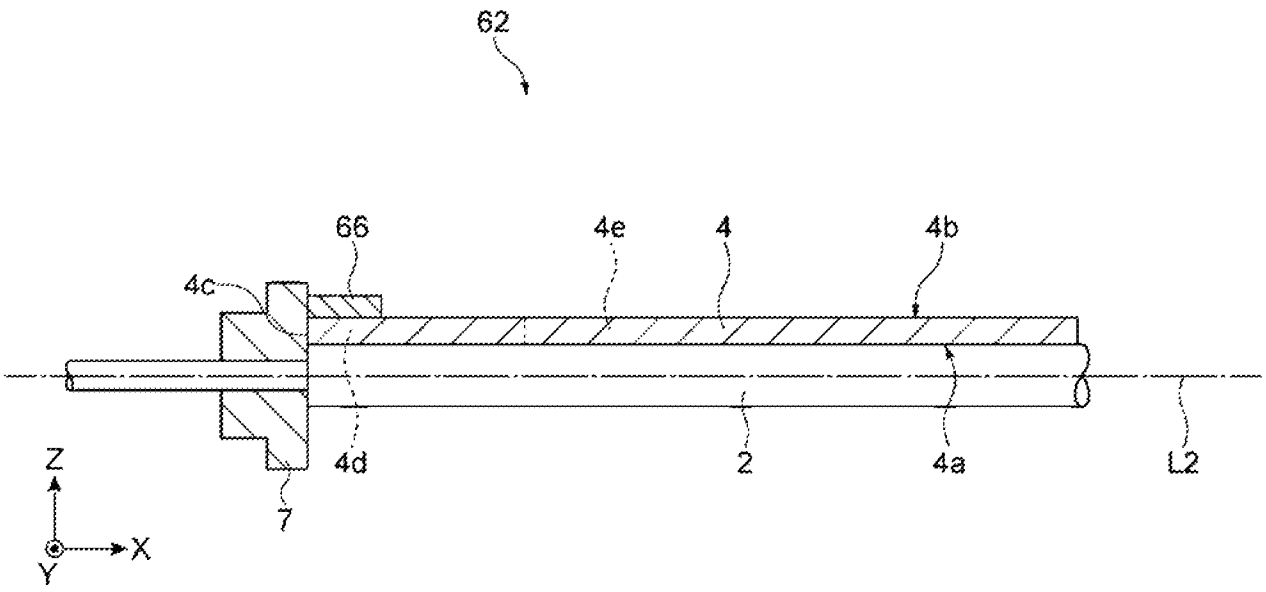
FIG. 16 is a cross-sectional view illustrating a drive roller, a wheel, and an endless belt.

In an example intermediate transfer unit, the endless belt 4 of the intermediate transfer unit 62 illustrated in FIG. 16 is an intermediate transfer belt to which a toner image is transferred. The endless belt 4 is formed by a resin or elastic body. As the resin which can be applied to the endless belt 4, for example, polyimide, polyamide imide, polyether ether ketone, polyvinylidene difluoride (PVDF), and the like can be exemplified. Further, the surfaces of these resins may be coated with, for example, acrylic or polyurethane. Further, as the elastic body which can be applied to the endless belt 4, for example, rubber type materials such as chloroprene rubber (CR) and nitrile rubber (NBR) can be exemplified.

The end portion 4*d* of the endless belt 4 in the width direction is located outside an image forming area 4*e* in the X direction. The image forming area 4*e* is an area to which the toner image is transferred. A portion corresponding to the end portion 4*d* of the endless belt 4 is thicker than the image forming area 4*e*. Since a reinforcement member 66 is provided at the end portion 4*d* of the endless belt 4, a portion corresponding to the end portion 4*d* of the endless belt 4 is thicker than a portion corresponding to the image forming area 4*e*. The reinforcement member 66 adheres to, for example, the endless belt 4. The reinforcement member 66 may be formed of the same material as that of the endless belt 4 or may be formed of a different material. As the reinforcement member 66, for example, a polyethylene terephthalate (PET) resin, a metal tape, or the like can be used.

The reinforcement member 66 may be located on the outer circumferential surface 4*b* (the front surface) of the endless belt, may be located on the inner circumferential surface 4*a* (the rear surface), or may be arranged to cover the end surface 4*c*. The end portion 4*d* may be thickened without forming the reinforcement member 66. Further, the outer circumferential surface of the wheel 7 is located at the outside in the radial direction in relation to the surface of the reinforcement member 66 while the endless belt 4 is wound on the drive roller 2. The wheel 7 is able to come into contact with the end surface 4*c* of the endless belt 4 and the reinforcement member 66.

In the intermediate transfer unit including such an endless belt 4, since the strength of the end portion 4*d* of the endless belt 4 is increased, the end surface 4*c* can be protected from contact with the wheel 7, to extend the lifetime of the endless belt 4 and to improve the reliability of the intermediate transfer unit 62.

Further, the end portion 4*d* of the endless belt 4 in the width direction may be formed to be harder than the image forming area 4*e*. As the high hardness treatment, for example, an ultraviolet (UV) curing treatment and a heat curing treatment can be performed. The end portion 4*d* can be cured by irradiating UV rays to the end portion 4*d* to cure the resin. Further, the end portion 4*d* can be cured by heating the resin. Further, a high hardness coating treatment may be performed as the high hardness treatment. As the high hardness coating treatment, for example, silicone resin, glass, or the like may be applied to the surface of the endless belt 4.

It is to be understood that not all aspects, advantages and features described herein may necessarily be achieved by, or included in, any one particular example. Indeed, having described and illustrated various examples herein, it should be apparent that other examples may be modified in arrangement and detail.

For example, in the belt driving device 1, the wheel 7 may be inserted through the suspension roller 3 (e.g. as the first roller). The steering roller 6 may be located on the side of the suspension roller 3. In addition, the steering roller 6 may be located at the lower side of the circumferential orbit of the endless belt 4 and may come into contact with the endless belt 4 from above.

LIST OF REFERENCE NUMBERS

1, 1B: belt driving device; 2: drive roller, first roller, second roller; 3: suspension roller, second roller, first roller; 4: endless belt; 4*e*: image forming area; 5, 35: belt position correction unit; 6: steering roller; 6*b*: first end portion (one end portion) of steering roller; 7, 37: wheel, or pulley; 8, 38: link mechanism; 9: bearing (bearing member); 31, 32: lap amount adjustment roller (lap amount adjustment mechanism); 44: third intermediate member, first pivotal arm; 45: first guide portion; 46: fourth intermediate member, second pivotal arm; 47: slide member; 48: second guide member; 61: color image forming apparatus; 62: intermediate transfer unit (belt driving device); 66: reinforcement member; A1: circumferential movement direction of endless belt; X: X direction (first direction); Y: Y direction (second direction); Z: Z direction (third direction).

The invention claimed is:

1. A belt driving device comprising:

a pair of belt rollers to drive an endless belt, the pair of belt rollers comprising a first roller and a second roller, wherein the first roller and the second roller extend in a first direction to face each other in a second direction intersecting the first direction;

a steering roller located between the first roller and the second roller, to rotate in a following manner with the movement of the endless belt, the steering roller comprising an end portion in a longitudinal direction that is moveable to tilt the steering roller;

a wheel located at an end portion of the first roller, the wheel protruding in a radial direction of the first roller, to contact an edge of the endless belt in a width direction, the wheel being moveable in the first direction with a movement of the endless belt in the first direction; and a link mechanism to tilt the steering roller by moving the end portion of the steering roller when the wheel moves outwardly in the first direction, the link mechanism to tilt the steering roller by moving the end portion of the steering roller to an upstream side or a downstream side in a circumferential movement direction of the endless belt.

2. The belt driving device according to claim 1, wherein the steering roller is located closer to the first roller than to the second roller.

3. The belt driving device according to claim 1, wherein the end portion of the first roller corresponds to a first end portion, wherein the first roller comprises a second end portion opposite the first end portion, wherein the wheel corresponds to a first wheel and the link mechanism corresponds to a first link mechanism, and wherein the belt driving device comprises a second wheel and a second link mechanism at the second end portion of the first roller.

4. The belt driving device according to claim 1, wherein a direction intersecting the first direction and the second direction is set as a third direction, and wherein a maximum movement amount of the end portion of the steering roller in the third direction is equal to or larger than a maximum strain amount of the belt driving device.

5. The belt driving device according to claim 1, wherein the link mechanism is provided at the end portion of the first roller, adjacent the wheel.

6. The belt driving device according to claim 1, wherein a direction intersecting the first direction and the second direction is set as a third direction, and wherein the link mechanism tilts the steering roller by moving the end portion of the steering roller to move away from the endless belt in the third direction.

7. The belt driving device according to claim 6, wherein the link mechanism includes:

a first intermediate member located at the end portion of the first roller, wherein the wheel is between the first intermediate member and the endless belt in the first direction, and wherein the first intermediate member is moveable outwardly in the first direction with a movement of the wheel, and a second intermediate member that is swingable about an axis line extending in the first direction and presses the end portion of the steering roller to move away from the endless belt in the third direction while swinging with the outward movement of the first intermediate member in the first direction.

8. The belt driving device according to claim 6, further comprising:

a biasing member to urge a bearing member rotatably supporting the steering roller in a direction of pressing the endless belt in the third direction.

9. The belt driving device according to claim 1, further comprising:

a lap amount adjustment mechanism located on an upstream side or a downstream side of the steering roller in the circumferential movement direction of the endless belt, the lap amount adjustment mechanism to press the end portion of the endless belt in the width direction against the steering roller to increase a contact area between the endless belt and the steering roller.

10. The belt driving device according to claim 1, wherein a direction intersecting the first direction and the second direction is set as a third direction, and wherein in a state in which the wheel is not pressed by the endless belt, a contact position between the steering roller and the endless belt is deviated in a direction of pressing the endless belt by a maximum strain amount or more of the belt driving device from a position of the endless belt when the steering roller does not project in the third direction.

11. The belt driving device according to claim 1, wherein a contact length between the steering roller and the endless belt in the circumferential direction of the steering roller is ¼ or more of a circumference of the steering roller.

12. The belt driving device according to claim 1, wherein the endless belt is a transfer belt for transferring a toner image, wherein the transfer belt comprises a resin and/or elastic body, and wherein an end portion of the transfer belt in the width direction is located outside an image forming area in the first direction and is formed to be harder or thicker than the image forming area.

13. The belt driving device according to claim 1, wherein the end portion of the endless belt in the width direction is subjected to a high hardness coating treatment.

14. The belt driving device according to claim 1, further comprising a reinforcement member located at the end portion of the endless belt in the width direction.

15. A belt driving device comprising:

a pair of belt rollers to drive an endless belt, the pair of belt rollers comprising a first roller and a second roller, wherein the first roller and the second roller extend in a first direction to face each other in a second direction intersecting the first direction;

a steering roller located between the first roller and the second roller, to rotate in a following manner with the movement of the endless belt, the steering roller comprising an end portion in a longitudinal direction that is moveable to tilt the steering roller;

a wheel located at an end portion of the first roller, the wheel protruding in a radial direction of the first roller, to contact an edge of the endless belt in a width direction, the wheel being moveable in the first direction with a movement of the endless belt in the first direction; and a link mechanism to tilt the steering roller by moving the end portion of the steering roller when the wheel moves outwardly in the first direction, the link mechanism to tilt the steering roller by moving the end portion of the steering roller to an upstream side or a downstream side in a circumferential movement direction of the endless belt, wherein a direction intersecting the first direction and the second direction is set as a third direction, and wherein the link mechanism includes:

a third intermediate member located at an outside of the wheel in the first direction, the third intermediate member to swing about an axis line extending in the third direction with a movement of the wheel;

a fourth intermediate member that includes a first guide portion tilted inward in the first direction as it extends away from the first roller in the second direction within a plane along the first direction and the second direction, the fourth intermediate member to swing about an axis line extending in the third direction when the third intermediate member swings;

a slide member that supports a bearing member rotatably supporting the end portion of the steering roller, the slide member to engage with the first guide portion of the fourth intermediate member, and to move along the second direction;

a second guide portion that extends along the second direction, the second guide portion to guide a movement of the slide member along the second direction; and a biasing member to urge an end portion of the first guide portion, inward in the first direction.

16. An imaging system comprising:

a pair of belt rollers to drive an endless belt along a belt path, the pair of belt rollers comprising a first roller and a second roller;

a steering roller located between the first roller and the second roller, the steering roller being tiltable to engage the endless belt;

a wheel located at an end of the first roller in abutment with an edge of the endless belt, the wheel to move along a rotation axis of the first roller, in an outward direction, when the endless belt shifts toward the wheel; and a link mechanism to transfer a movement of the wheel in the outward direction, to a tilting of the steering roller, in order to urge the endless belt to shift away from the wheel toward the belt path, the link mechanism to tilt the steering roller by moving the end portion of the steering roller to an upstream side or a downstream side in a circumferential movement direction of the endless belt.

17. The imaging system according to claim 16, wherein the link mechanism comprises:

a shift member adjacent the wheel, to be urged by the wheel in the outward direction, wherein the shift member has an inclined surface; and a pivoting arm having a first end and a second end opposite the first end, wherein the first end is coupled with the inclined surface of the shift member, the first end to be urged away from the rotation axis of the first roller, by following the inclined surface of the shift member, when the shift member is moved in the outward direction, and the second end being coupled with an end of the steering roller, the second end to pivotally move when the first end is urged, in order to tilt the steering roller.

18. The imaging system according to claim 16, wherein the link mechanism comprises:

a first pivotal arm coupled to a side of the wheel, wherein a movement of the wheel in the outward direction urges the first pivotal arm to pivot; and a second pivotal arm coupled to the first pivotal arm, to pivot responsive to a pivoting of the first pivotal arm, wherein the second pivotal arm comprises a guide to engage an end of the steering roller, in order to urge the steering roller to tilt when the second pivotal arm is tilted.

* * * * *